US006864454B2

(12) United States Patent
Shimizu et al.

(10) Patent No.: US 6,864,454 B2
(45) Date of Patent: Mar. 8, 2005

(54) SWITCH APPARATUS

(75) Inventors: Keiichi Shimizu, Kasugai (JP); Yasuhide Tanaka, Owariasahi (JP); Kiyotaka Yamaguchi, Nagoya (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 10/688,809

(22) Filed: Oct. 16, 2003

(65) Prior Publication Data

US 2004/0124794 A1 Jul. 1, 2004

(30) Foreign Application Priority Data

Oct. 29, 2002 (JP) ..... 2002-313766

(51) Int. Cl.[7] ..... H01H 5/02
(52) U.S. Cl. ..... 200/563
(58) Field of Search ..... 200/560–563, 200/553–557, 252, 253, 6 C, 6 R, 339

(56) References Cited

U.S. PATENT DOCUMENTS

| | | | | | |
|---|---|---|---|---|---|
| 3,674,953 | A | * | 7/1972 | Brevick | 200/548 |
| 5,285,039 | A | * | 2/1994 | Satoh | 200/563 |
| 5,446,253 | A | * | 8/1995 | Oshgan | 200/556 |
| 5,770,828 | A | * | 6/1998 | Niemeyer | 218/48 |
| 5,805,402 | A | * | 9/1998 | Maue et al. | 361/93.1 |
| 5,902,972 | A | * | 5/1999 | Nestor et al. | 200/1 B |
| 6,005,201 | A | * | 12/1999 | Tanaka et al. | 200/16 C |
| 6,054,655 | A | * | 4/2000 | Rudolph et al. | 200/16 R |
| 6,091,038 | A | * | 7/2000 | Murphy et al. | 200/563 |
| 6,239,392 | B1 | * | 5/2001 | Serizawa et al. | 200/5 R |
| 6,774,329 | B2 | * | 8/2004 | Shimizu et al. | 200/339 |

FOREIGN PATENT DOCUMENTS

| | | | | |
|---|---|---|---|---|
| EP | 43496 | * | 1/1982 | |
| JP | 2001-202863 | | 7/2001 | H01H/50/56 |
| JP | P2004-96918 A | | 3/2004 | H02P/3/10 |

OTHER PUBLICATIONS

Toyota Vitz; "Electrical Wiring Diagram"; Feb. 6, 1999; 4 pgs.

Patent Abstracts of Japan, Publication No. 2001–202863 dated Jul. 27, 2001 (2 pgs.).

* cited by examiner

*Primary Examiner*—Elvin Enad
*Assistant Examiner*—Lisa Klaus
(74) *Attorney, Agent, or Firm*—Osha & May L.L.P.

(57) ABSTRACT

A switch apparatus of the invention can avoid contact damage without inviting a drastic increase in a size even when applied to a high power source voltage and does not deteriorate return feeling to a neutral state. The switch apparatus includes a switch A for cutting off connection between one side driving input of a DC motor and a negative plate side power source, a switch B for cutting off connection between the other side driving input and the negative plate side power source, and a switch C for cutting off connection between the one side driving input and the positive plate side power source and connection between the other side driving input and the positive plate side power source, wherein the switch A and the switch B are normally-closed type switches and the switch C is a normally-open type switch. The switch C is opened at a predetermined time before the switch A or the switch B is closed, and cuts off in advance a power source route to avoid the occurrence of dead short-circuit. When the switch C has a slide type structure, switch feeling of contacts of the switch C can be improved.

8 Claims, 19 Drawing Sheets

SWITCH APPARATUS

BACKGROUND OF THE INVENTION

1. Field of the Invention

This invention relates to a switch apparatus for rotating and stopping a DC motor for opening and closing windows of a vehicle such as an automobile, for example, or DC motors used for similar applications. More particularly, the invention relates to a switch apparatus that will be used appropriately for a DC motor operating at a high power source voltage (in a 42 V electric system, for example).

2. Description of the Related Art

Prior Art: Re: 42 V Electric System

Existing automobiles have employed a 14 V electric system. As the number of electronic appliances mounted to the automobiles has increased, however, it,has become more difficult for the 14 V electric system to meet required power consumption. To solve this problem, an industry-university cooperation consortium has reached after intensive global discussion the consensus that a threefold higher voltage system, that is, "42 V system", be employed in view of safety to the human body, and so forth.

[Prior Art as the Base: First Prior Art]

Electric equipment operating in the 42 V electric system includes a DC motor for opening and closing windows, assembled inside doors (so-called "DC motor for driving power windows"), for example.

FIG. 10 of the accompanying drawings is a structural view FIG. 10A of a prior art switch apparatus for rotating (normally and reversely) and stopping the DC motor for opening and closing the windows and its circuit diagram FIG. 10B (refer to non-patent reference 1, for example).

This switch apparatus 100 is fitted to each armrest installed inside a door of a front seat or a rear seat of the automobile. The state of the switch apparatus 100 shown in the drawing represents the state where a DC motor for driving power windows (hereinafter called "DC motor") 101 is at halt. In other words, this state represents the one where a passenger inside the automobile does not operate a knob 102. This state will be hereinafter called "neutral state".

The knob 102 is fitted to a case 103 on the door side in such a fashion as to be capable of turning by a predetermined angle both clockwise and counter-clockwise in the drawing. When the knob 102 is turned clockwise, the window is closed (hereinafter called "UP state") and when it is turned counter-clockwise, the window is opened (hereinafter called "DOWN state"). When the operating force applied to the knob 102 is released (or a finger is released), a spring 104 and a plunger 105 buried into the knob 102 return the knob 102 to the neutral state and keep thereafter this neutral state.

A lower protuberance 106 of the knob 102 extending inside the case 103 exists at the position shown in the drawing when the knob 102 is under the neutral state. When the knob 102 is brought into the UP state, however, the lower protuberance 106 rocks to the left in the drawing (see FIG. 12A). When the knob 102 is brought into the DOWN state, the lower protuberance 106 rocks to the right in the drawing (not shown in the drawing).

A switch unit 108 mounted to a printed substrate 107 is provided inside the case 103. This switch unit 108 operates as a momentary type "2-circuit 4-contact type" switch and its appearance Is shown in FIG. 11. The switch unit 108 includes two common terminals 110 and 111 extended from one of the side surfaces of a casing 109, one normally-open terminal 112 extended from the other side surface of the casing 109 and two normally-closed terminals 113 and 114 extended from the bottom surface of the casing 109. These terminals 110 to 114 are soldered to a necessary conduction circuit formed on the printed substrate 107 and are electrically connected to a power source line (hereinafter called "+B line") 115, a ground line 116 and a DC motor 101 to thereby accomplish the circuit diagram shown in FIG. 10B.

Switches A and B of two circuits are mounted inside the switch unit 108 as shown in FIG. 10(*b*). These switches A and B are exclusively switched in accordance with a slide position of a slider 117 that is fitted to the upper surface of the switch unit 108. Incidentally, the term "exclusive switching" hereby used means that only an NC (normally-closed) contact of either one of the switches A and B is opened. (In other words, only an NO (normally-open) contact of that switch is closed).

More concretely, when the slider 117 exists at the position shown in the drawing (under the neutral state), connection between a moving contact 118 of the switch A and the NC contact 122 and connection between a moving contact 119 of the switch B and an NC contact 123 are closed. At this position the NO contacts 120 and 121 and the NC contacts 122 and 123 of the two sets of the switches A and B are under the literal state (NO→normally open, NC→normally closed). When the slider 117 moves in a direction indicated by a leftward arrow L (hereinafter merely called "L direction") in FIG. 11A (under the "UP state"), the closed state between the moving contact 119 of the switch B and the NC contact 123 is kept, the closed state of the NC contact 122 of the switch A is released and connection between the moving contact 118 and the NO contact 120 is afresh closed. Further, when the slider 117 moves in a direction indicated by a rightward arrow R (hereinafter merely called "R direction) (under the "DOWN state") in FIG. 11A, the closed state between the moving contact 118 of the switch A and the contact 122 is kept, the closed state of the NC contact 123 of the switch B is released and connection between the moving contact 119 and the NO contact 121 is afresh closed.

Such a switching operation is brought forth by the operation of the slider 117 and by the lower surface shape of the slider 117. FIG. 11C is a sectional view of the slider 117 along a line X—X and FIG. 11D is a sectional view of the slider 117 along a line Y—Y. The X—X sectional part of the slider 117 is formed to an increased thickness at its right half portion and the Y—Y sectional part of the slider 117 is formed to an increased thickness at its left half portion. The switches A and B are exclusively switched in accordance with the positional relationship of these increased thickness portions as will become more apparent from the following explanation.

Incidentally, FIG. 10A depicts only one of the common terminals 110 and 111 and only one of the normally-closed terminals 113 and 114, for example. This is because each terminal is aligned back and forth and the rear terminal is hidden by the front terminal and cannot be observed.

The switch unit 108 operates as the momentary type "2-circuit 4-contact type" switch as explained already. In other words, the moving contacts 118 and 119, the NO contacts 120 and 121 and the NC contacts 122 and 123 are connected to the common terminals 110 and 111, the normally-open contact 112 and the normally-closed contacts 113 and 114, respectively. In this way, contact switching (switching of the moving contact 118 and the NO contact 120 and the NC contact 122 and switching of the moving contact 119 and the NO contact 121 and the NC contact 123) of the two circuits can be carried out exclusively.

Each of the moving contacts 118 and 119 is fitted to the distal end of each metal leaf spring type moving plate 124, 125. Push buttons 126A and 126B (push button 126A is for the switch A and the push button 126B is for the switch B) urge these metal leaf spring type moving plates 124 and 125 downward in the drawing.

The push buttons 126A and 126B keep contact with a lower surface of the slider 117 (see FIG. 11) capable of moving in the transverse direction in the drawing. One of the push buttons 126A is pushed down along the lower surface shape (X—X section increased thickness part: see FIG. 11C) with the movement of the slider 117 to the left (L direction) in the drawing as shown in FIG. 12A. The other push buttons 126B is pushed down along the lower surface shape of the slider 117 (Y—Y section increased thickness part: see FIG. 11D) with the movement of the slider 117 to the right (R direction) in the drawing.

An upper surface protuberance 127 of the slider 117 engages with the distal end of the lower protuberance 106 of the knob 102. The slider 117 slides to the right and left in the drawing (L-R direction) while following the rocking motion of the lower protuberance 106 of the knob 102 (UP state and DOWN state).

Therefore, when the knob 102 is pulled up and brought into the UP state in this switch apparatus 100, the slider 117 slides in the L direction and the push button 126A keeping contact with the X—X section increased thickness part of the slider 117 moves down. In consequence, connection between the moving contact 118 of the switch A and the NC contact 122 is opened and connection between the moving contact 118 of the switch A and the NO contact 120 is closed. When a finger is released from the knob 102 to attain the neutral state, the slider 117 returns to its original position, the push button 126A moves up and connection between the moving contact 11,8 of the switch A and the NC contact 122 is closed.

When the knob 102 is pushed down to attain the DOWN state, the slider 117 slides in the R direction and the push button 126B keeping contact with the Y—Y section increased thickness part of the slider 117 moves down, so that connection between the moving contact 119 of the switch B and the NC contact 123 is opened while connection between the moving contact 119 of the switch B and the NO contact 121 is closed. When the finger is released from the knob 102 to attain the neutral state, the slider 117 returns to its original position, the push button 126B moves up and connection between the moving contact 119 of the switch B and the NC contact 123 is closed.

When the knob 102 is under the neutral state in the circuit diagram shown in FIG. 10B, each contact of the switches A and B is under the state shown in the drawing. In other words, connection between the moving contact 118 of the switch A and the NC contact 122 is closed and connection between the moving contact 119 of the switch B and the NC contact 123 is closed. Under this state, connection between the DC motor 101 and the +B line 115 is cut off and a potential (negative plate side power source) of the ground line 116 is applied to the two driving inputs of the DC motor. Consequently, the DC motor 101 is at halt. This rotation stop state will be hereinafter called motor stop mode".

In the circuit diagram shown in FIG. 12B, on the other hand, when the knob 102 is under the UP state, each contact of the switches A and B is under the state shown in the drawing. In other words, connection between the moving contact 118 of the switch A and the NO contact 120 is closed and connection between the moving contact 119 of the switch B and the NC contact 123 is closed. Under this state, a closed circuit of the +B line 115→NO contact 120→moving contact 118→DC motor 101→moving contact 119→NC contact 123→ground line 116 is formed. In consequence, the DC motor 101 rotates in the direction that closes the windows. This rotation direction is regarded as the normal rotation direction and the rotation state will be hereinafter called "motor normal rotation mode".

Though not shown in the drawing, when the knob 102 is under the DOWN state, connection between the moving contact 118 of the switch A and the NC contact 122 is closed and connection between the moving contact 119 of the switch B and the NO contact 121 is closed. Under this state, a closed circuit of the +B line 115→NO contact 121→moving contact 119→DC motor 101→moving contact 118→NC contact 122→ground line 116 is formed. In consequence, the DC motor 101 rotates in the direction that opens the windows. This rotation direction is regarded as the reverse rotation direction and the rotation state will be hereinafter called "motor reverse rotation mode".

Therefore, the switches A and B of the switch unit 108 can acquire the "motor stop mode" by applying the negative plate side power source (potential of the ground line 116) to each of one and other side driving inputs of the DC motor 101 and bringing the DC motor 101 into the stop state, the "motor normal rotation mode" by applying the positive plate side power source (potential of the +B line 115) to one side driving input of the DC motor 101 and the negative plate side power source (potential of the ground line 116) to the other side driving input and bringing the DC motor 101 to the normal rotation state, and the "motor reverse rotation mode" by applying the negative plate side power source (potential of the ground line 116) to one side driving input of the DC motor 101 and the positive side power source (potential of the +B line 115) to the other side driving input and bringing the DC motor 101 to the reverse rotation state.

The explanation given above represents the example where the rotation of the DC motor 101 is controlled by use of one switch unit 108. However, switch apparatuses of other types that can open and close the windows of the other seats (front and rear seats other than the driver's seat) are available depending on models of the automobiles.

FIG. 13 is its circuit diagram (refer to the non-patent reference 1. for example). This circuit includes in combination a switch unit 108 for the driver's seat and a switch unit 108' for another seat and can rotate and stop the DC motor 101 (DC motor for opening and closing the window of another seat) not only from another seat but also from the driver's seat.

In the explanation given above, one each terminal (common terminal 110, 111 and normally-closed terminal 113, 114) is allocated to the moving contact 118, 119 and to the NC contact 122, 123 and one terminal (normally-open terminal 112) is allocated to the NO contact 120, 121. (In other words, the switch apparatus has five terminals in total). However, for example, as shown in FIG. 14, this arrangement is not restrictive and a type (having four terminals in total) is also known in which contacts connected to the ground line 116 (NC contacts 122 and 123 of the switches A and B) are wired to one another inside the unit and are extended from one terminal 114*a* and connected to the ground line 116. Alternatively, there is known another type having one circuit for a switch mechanism and two such circuits are arranged and used. In this case, the switch unit has six terminals in total.

[Problems of First Prior Art]

The prior art switch apparatus (shown in FIGS. 10 to 14) explained above operates normally without problems when it is applied to the original 14 V electric system. When the switch apparatus is applied to an electric system having a higher voltage such as the 42V electric system, however, a large current flows through the contacts connected to the negative plate power source during the return from the UP state to the neutral state or during the return from the DOWN state to the neutral state, and imparts damage to the contacts.

FIG. 15 is an explanatory view of this contact damage, wherein FIG. 15A presets the UP state, FIG. 15B represents the state "immediately before" the return to the neutral state and FIG. 15C represents the return to the neutral state. The difference from the explanation of the prior art given above resides in that a higher voltage (power source voltage of the 42 V electric system; hereinafter called "42 V") is applied to the +B line 115.

Under the UP state as shown in FIG. 15A, connection between the NO contact 120 of the switch A and the moving contact 118 is closed and connection between the moving contact 119 of the switch B and the NC contact 123 is closed. Therefore, a closed circuit of the +B line 115→NO contact 120→moving contact 118→DC motor 101→moving contact 119→NC contact 123→ground line 116 is formed. In consequence, the DC motor 101 rotates in the direction that closes the windows. Next, as shown in FIG. 15B, when the finger is released from the knob 102, the close state between the NO contact 120 of the switch A and the moving contact 118 is released and the moving contact 118 starts moving towards the NC contact 122 while creating arc discharge 128 within an allowable range between it and the NO contact 120. Finally, connection between the moving contact 118 of the switch A and the NC contact 122 is closed as shown in FIG. 15C, the supply of the power source voltage to the DC motor 101 is cut off and the DC motor 101 comes to halt.

When the switch unit 108 of the prior art is employed, the contact gap is as small as about 0.5 mm and an arc discharge voltage for 42 V cannot be secured. Therefore, the moving contact 118 in which a voltage of several voltages remains applied is connected to the NC contact 122. According to the experiments carried out by the inventors of this application, a large current 129 (100 A or more) flows this time from the moving contact 118 to the ground line 116 through the NC contact 122 within a short time (about 0.5 ms) and a large discharge phenomenon (hereinafter called "dead short-circuit") 130 develops between the NO contact 120 and the NC contact 122 and imparts damage (contact damage or contact destruction) to the moving contact 118 of the switch A and to the NC contact 122. This dead short-circuit 130 is likely to develop particularly in a range of an extremely quicker contact opening/closing speed (1,000 mm/s or more) than the ordinary contact opening/closing speed (100 to 400 mm/s).

Incidentally, to cope with the arc discharge, it is customary to enlarge the contact gap so as to correspond to the degree of the power source voltage. When the contact gap is enlarged (to about 4 mm, for example), the arc discharge voltage can be increased and the moving contact 118 can be connected to the NC contact 122 under the state where no voltage is applied to the moving contact 118 with the result that the contact damage can be avoided. According to this measure, however, the switch unit becomes drastically greater in scale and cannot be compactly mounted to the automobile.

[Improved Prior Art: Second Prior Art]

Therefore, the inventors of the invention have already proposed a "Switch Apparatus" (Japanese Patent Application No. 2002-256392, filed on Sep. 2, 2002) that improves the first prior art described above and does not invite the drastic increase of the scale of the switch unit even when applied to a higher power source voltage such as the 42 V electric system. This proposed technology is hereinafter called "second prior art".

FIG. 16 is a structural view showing principal portions of a switch apparatus 200 according to the second prior art.

The switch apparatus 200 can be broadly divided into two switch elements (hereinafter called "first switch element 201" and "second switch element 202", respectively) and a switch operation element 203 for conducting switching operations of these two switch elements 201 and 202.

The explanation will be given on each element. The first switch element 201 has six fixed electrode 201*a* to 201*f* of flat sheet-like metal conductors inserted into a molding base, not shown (or shaped into a thin film) and two moving plates 201*g* and 201*h*. The six fixed electrodes 201*a* to 201*f* are made of a metal material having high conductivity and highly resistant to wear. Three electrodes are aligned into a set and each set is Juxtaposed with each other. The first set has the fixed electrodes 201*a* to 201*c* and the second set has the remaining fixed electrodes 201*d* to 201*f*.

The fixed electrodes 201*a* to 201*c* of the first set are aligned in the order of the fixed electrode 201*a*, the fixed electrode 201*b* and the fixed electrode 201*c* from the right to the left in the drawing along an imaginary axis 204. The fixed electrodes 201*d* to 201*f* of the second set are aligned in the order of the fixed electrode 201*d*, the fixed electrode 201*e* and the fixed electrode 201*f* from the left to the right in the drawing along the imaginary axis 204.

A gap L2*a* between the fixed electrode 201*b* and the fixed electrode 201*c* is smaller than a gap Lla between the fixed electrode 201*a* and the fixed electrode 201*b*. Similarly, a gap L2*b* between the fixed electrode 201*e* and the fixed electrode 201*f* is smaller than a gap L1*b* between the fixed electrode 201*d* and the fixed electrode 201*e*. Here, L1*a*=L1*b* and L2*a*=L2*b*.

The two moving plates 201*g* and 201*h* have a suitable shape so that they can slide on the fixed electrodes 201*a* to 201*c* of the first set and on the fixed electrodes 201*d* to 201*f* of the second set along the imaginary axis 204, respectively. For example, the two moving plates 201*g* and 201*h* have two curve protuberances 201*g*_1 and 201*g*—2 (201*h*_1 and 201*h*_2 in the moving plate 201*h*), and are made of a metal material having high conductivity and highly resistant to wear.

Springs 201*i* and 201*j* urge down the two moving plates 201*g* and 201*h*, respectively. This urging force pushes the two curve protuberances 201*g*_1 and 201*g*_2 (201*h*_1 and 201*h*_2 in the moving plate 201*h*) of the two moving plates 201*g* and 201*h*, respectively, onto the fixed electrodes 201*a* to 201*c* of the first set and onto the fixed electrodes 201*d* to 201*f* of the second set.

The gap between the two curve protuberances 201*g*_1 and 201*g*_2 (201*h*_1 and 201*h*_2 in the moving plate 201*h*) of the moving plates 201*g* and 201*h* is set to a gap greater than L1*a* (L1*b*) described above. More concretely, in the case of one of the moving plates 201*g* by way of example, the gap is set so that the moving plate 201*g* can come into contact with only both of the fixed electrodes 201*a* and 201*b* of the first set and can close connection between these metal conductors, and can come into contact with only both of the fixed electrodes 201*b* and 201*c* of the first set and can close connection between these metal conductors.

The two moving plates 201*g* and 201*h* can move to the right and left in the drawing along the imaginary axis 204 while keeping the parallel state shown in the drawing due to the operation of the switching operation element 203.

When the two moving plates 201*g* and 201*h* exist at the positions shown in the drawing (hereinafter called "neutral state") in the first switch element 201 having such a construction, the two curve protuberances 201*g*_1 and 201*g*_2 of one of the moving plates 201*g* come into contact with both of the fixed electrodes 201*b* and 201*c* of the first set. Therefore, these conductors can be brought into the closed state. The curve protuberances 201*h*_1 and 201*h*_2 of the other moving plate 201*h* come into contact with both fixed electrodes 201*e* and 201*f* of the second set and these conductors can be closed. In other words, connection between the fixed electrodes 201*a* and 201*b* of the first set can be brought into the open state and connection between the fixed electrodes 201*d* and 201*e* of the second set can be brought into the open state.

When the moving plate 201*g* is moved to the right in the drawing from the neutral state, its curve protuberances 201*g*_1 and 201*g*_2 come into contact with both fixed electrodes 201*a* and 201*b* of the first set and these conductors can be brought into the closed state. In other words connection between the fixed electrodes 201*b* and 201*c* of the first set can be brought into the open state. At this time, the other moving plate 201*h* simultaneously moves from the neutral state to the right in the drawing, and its curve protuberances 201*h*_1 and 201*h*_2 keep the fixed electrodes 201*f* and 201*e* of the second set under the closed state.

Similarly, when the moving plate 201*h* is moved to the left in the drawing from the neutral state, its curve protuberances 201*h*_1 and 201*h*_2 come into contact with both fixed electrodes 201*d* and 201*e* of the second set and these conductors can be brought into the closed state. In other words, connection between the fixed electrodes 201*e* and 201*f* of the second set can be brought into the open state. At this time, the other moving plate 201*g* simultaneously moves from the neutral state to the left in the drawing, and the curve protuberances 201*g*_1 and 201*g*_2 of the moving plate 201*g* keep the fixed electrodes 201*b* and 201*c* of the first set under the closed state.

A C part at the lower left of the drawing represents the first switch element 201 by the circuit diagram. In this circuit diagram, the moving plates 201*g* and 201*h* and the fixed electrodes 201*b* and 201*e* form two moving contacts. The fixed electrodes 201*a* and 201*d* form the NO contacts, respectively, and the fixed electrodes 201*c* and 201*f* form the NC contacts, respectively.

When the moving plates 201*g* and 201*h* exist under the neutral state shown in the drawing, the NC contacts (201*c*, 201*f*) are under the closed state. When one of the moving plates 201*g* moves from the neutral state to the right along the imaginary axis 204, the NC contact (201*c*) is released from the closed state and the NO contact (201*a*) is brought into the closed state. When the other moving plate 201*h* moves to the left from the neutral state along the imaginary axis 204, the NC contact (201*f*) is released from the closed state and the NO contact (201*d*) is brought into the closed state.

In other words, this first switch element 201 operates as a "2-circuit 4-contact type" switch. When the centering positions of the moving plates 201*g* and 201*h* are set to the neutral state shown in the drawing through the operation of the switching operation element 203, two (201*c*, 201*f*) of the four fixed electrodes 201*a*, 201*c*, 201*d* and 201*f* positioned on both right and left sides operate as the NC (normally closed) contacts and the remaining two (201*a*, 201*d*) operate as the NO (normally-open) contacts.

Next, the second switch element 202 will be explained. The second switch element 202 is constituted by mounting two sets of switch mechanisms including the following members and having the same construction with each other onto the same base substrate (not shown) as that of the first switch element 201.

The second switch element 202 includes U-shaped members 202*a* and 202*b* implanted onto the base substrate described above, metal leaf spring type moving plates 202*c* and 202*d* each having one of the ends thereof held by the U-shaped member 202*a*, 202*b*, moving contacts 202*e* and 202*f* each being fitted to the other end of the metal leaf spring type moving plate 202*c*, 202*d*, inverted L-shaped members 202*g* and 202*h* implanted onto the base substrate, and fixed contacts 202*i* and 202*j* fitted to the downward ends of the inverted L-shaped members 202*g* and 202*h*, respectively.

A notch 202*k*, 202*m* is defined at a part of each metal leaf spring type moving plate 202*c*, 202*d*. The notches 202*k* and 202*m* are curved and butted against the U-shaped members 202*a* and 202*b*, respectively. Resiliency of the notches 202*k* and 202*m* always keeps the moving contacts 202*e* and 202*f* fitted to the other end under the contact state with the fixed contacts 202*i* and 202*j* (under the closed state), respectively. Therefore, the fixed contacts 202*i* and 202*j* operate as the NC (normally-closed) contacts.

When downward external force (exceeding resiliency of the notches 202*k* and 202*m*) is applied to the metal leaf spring type moving plates 202*c* and 202*d* through push buttons 202*n* and 202*p* disposed discretely, the distal end of each metal leaf spring type moving plate 202*c*, 202*d* lowers, so that the contact (closed state) between the moving contact 202*e*, 202*f* and the fixed contact 202*i*, 202*j* is released and the line between these contact is opened.

AD portion in FIG. 16 represents the second switch element 202 by a circuit diagram. In this circuit diagram, two moving contacts 202*e* and 202*f* are closed with respect to the fixed contacts (NC contacts) 202*i* and 202*j*, respectively. Assuming hereby that the downward external force is applied to one of the metal leaf spring type moving plates 202*c*, the closed state between the moving contact 202*e* and the fixed contact (NC contact) 202*i* is released and these contacts are open. Similarly, when the downward external force is applied to the other metal leaf spring type moving plate 202*d*, the closed state between the moving contact 202*f* and the fixed contact (NC contact) 202*j* is released and these contacts are open. Therefore, the second switch element 202 operates as a "2-cricuit 2-contact type" switch having a pair of NC contacts (202*i* and 202*j*).

Next, the switching operation element 203 will be explained. The switching operation element 203 indicated by dash line in the drawing has the following functions 1 to 4.

<Function 1>

When the operation input by the driver (such as the UP and DOWN operations of the knob 102 explained at the beginning) does not exist, the switching operation element 203 can keep the first and second switch elements 201 and 202 under the neutral state shown in the drawing.

<Function 2>

The switching operation element 203 can return the first and second switch elements 201 and 202 to the neutral state shown in the drawing immediately after the release of the operation input by the driver.

<Function 3>

The switching operation element 203 can move both moving plates 201*g* and 201*h* of the first switch element 201 from the neutral state shown in the drawing in one direction (to the left in the drawing, for example) along the imaginary axis 204 in response to one operation input (for example, UP operation) by the driver and at the same time, can open one of the NC contacts (fixed contact 202*j*, for example) of the second switch element 202.

<Function 4>

The switching operation element 203 can move both moving plates 201*g* and 201*h* of the first switch element 201 from the neutral state shown in the drawing in the other direction (to the right in the drawing, for example) along the imaginary axis 204 in response to another operation input (for example, DOWN operation) by the driver and at the same time, can open the other NC contact (fixed contact 202*i*, for example) of the second switch element 202.

FIGS. 17 and 18 are explanatory views useful for explaining the operations of the switching operation element 203. Referring to FIG. 17, the switch operation element 203 includes operation means 203*a* having a similar structure to the structure of the slider 117 in the switch apparatus of the first prior art. This operation means 203*a* slides in the transverse direction in the drawing (L-R direction) along the imaginary axis 204 (that is the same as the imaginary axis 204 in FIG. 16) while following the movement of the knob 102 (UP state⇆neutral state⇆DOWN state) in the switch apparatus of the first prior art.

When the operation means 203*a* moves (slides) in one direction (hereinafter called "L direction) along the imaginary axis 204, connection between the fixed contact 202*j* of the second switch element 202 and its moving contact 202*f* is first open and then both moving plates 201*g* and 201*h* of the first switch element 201 move from the neutral state shown in the drawing in the L direction along the imaginary axis 204, thereby closing connection between the fixed electrodes 201*d* and 201*e*. Furthermore, connection between the fixed contact 202*j* of the second switch element 202 and its moving contact 202*f* is closed, thereby accomplishing the opening direction rotation driving function of the DC motor for opening/closing the windows. Therefore, all these associated contacts (201*h*, 201*d*, 201*e*, 202*f* and 202*j*) unitarily constitute the UP side motor driving switch group (UP switch group).

When the operation means 203*a* moves (slides) in the other direction (hereinafter called "R direction") along the imaginary axis 204, connection between the fixed contact 202*i* of the second switch element 202 and its moving contact 202*e* is first open and then both moving plates 201*g* and 201*h* of the first switch element 201 move from the neutral state shown in the drawing in the R direction along the imaginary axis 204, thereby closing connection between the fixed electrodes 201*a* and 201*b*. Furthermore, connection between the fixed contact 202*i* of the second switch element 202 and its moving contact 202*e* is closed, thereby accomplishing the closing direction rotation driving function of the DC motor for opening and closing the windows. Therefore, all these associated contacts (201*g*, 201*a*, 201*b*, 202*e* and 202*i*) unitarily constitute the DOWN side motor driving switch group (DOWN switch group).

FIG. 18 is an explanatory view useful for explaining the operations of one of the switch groups (UP switch group for convenience). The X—X section and the Y—Y section represent the sectional plane in FIG. 17. The first stroke represents the neutral state at the initial position. Under this neutral state, the moving plate 201*h* of the first switch element 201 is positioned between the fixed electrode 201*e* at the center and the fixed electrode 201*f* at the right end and closes connection between these electrodes. The push button 202*p* of the second switch element 202 is lifted up while engaging with the lower surface recess 203*b* of the operation means 203*a*. The metal leaf spring type moving plate 202*d* is not inverted downward and connection between the moving contact 202*f* fitted to the distal end of the metal leaf spring type moving plate 202*d* and its fixed contact 202*j* is closed.

When the operation shifts from this state to the UP state (when the operation means 203*a* is moved in the L direction), the moving plate 201*h* of the first switch element 201 keeps the position in the first stroke described above, that is, in between the fixed electrode 201*e* at the center and the fixed electrode 201*f* at the right end, and closes connection between these electrodes in the second stroke immediately after the shift to the UP state. However, the push button 202*p* of the second switch element 202 shifts from the lower surface recess 203*b* of the operation means 203*a* to the increased thickness portion and is pushed down. Since the metal leaf spring type moving plate 202*d* is bent downward in this instance, the closed state between the moving contact 202*f* fitted to the distal end of the metal leaf spring type moving plate 202*d* and its fixed contact 202*j* is released to the open state.

Next, the UP state further proceeds to the third stroke, the moving plate 201*h* of the first switch element 201 is positioned between the fixed electrode 201*d* at the left end and the fixed electrode 201*e* at the center, and closes these electrodes while bringing connection between the fixed electrode 201*e* at the center and the fixed electrode 201*f* at the right end into the open state. At this time, the push button 202*p* of the second switch element 202 still keeps its position at the increased thickness portion of the operation means 203*a* and the metal leaf spring type moving plate 202*d* keeps the downward inverted state. Therefore, connection between the moving contact 202*f* fitted to the distal end of the metal leaf spring type moving plate 202*d* and its fixed contact 202*j* is kept open.

When the UP state further proceeds to the final stroke (fourth stroke), the moving plate 201*h* of the first switch element 201 keeps the position in the third stroke, that is, between the fixed electrode 201*d* at the left end and the fixed electrode 201*e* at the center, and closes connection between these electrodes. However, the push button 202*p* of the second switch element 202 is lifted up while engaging with the lower surface recess 203*c* of the operation means 203*a* (recess adjacent to the lower surface recess 203*b*), the metal leaf spring type moving plate 202*d* returns to the horizontal state and connection between the moving contact 202*f* fitted to the distal end of the metal leaf spring type moving plate 202*d* and its fixed contact 202*j* is closed.

FIG. 19 is a circuit diagram of a rotation (normal rotation/reverse rotation)/stop system of a DC motor for opening and closing windows that is constituted by the application of the switch apparatus 200 of this prior art (second prior art). In the drawing, a +B line 115 is a positive plate side power source (+B line of an automobile electric system). A ground line 116 is a negative plate side power source (ground line of the system). The impressed voltage of the +B line 115 is higher than that of the 14 V electric system and is a voltage of a 42 V electric system (power source voltage; 42V), for example.

Referring to FIG. 19, FIG. 19A represents a circuit under the DOWN state, for example, FIG. 19D represents a circuit when the state returns from the DOWN state to the neutral state, and FIG. 19B and FIG. 19C represent circuits under a transient state between them. Under the DOWN state, each contact of first and second switch elements 201 and 202 is under the state corresponding to the fourth stroke in FIG. 18.

In other words, connection between a moving plate (201*g*) of the first switch element 201 and an NO contact (201*a*) and connection between a moving plate (201*h*) and an NC contact (201*f*) are closed, and two NC contacts (202*i*, 202*j*) of the second switch element 202 are closed.

Therefore, the potential (+42 V) of the +B line 115 is applied to one side driving input of the DC motor 101 and the potential (0 V) of the ground line 116 is applied to the other side driving input of the DC motor 101. In consequence, the DC motor 101 rotates in one direction (in a window opening direction). When the DOWN state is released under this state, that is, when a finger is released from the knob 102 as described at the beginning, the state shifts to the state shown in FIG. 19B. Under this state, the contacts of the first switch element 201 remain as such but both of the two NC contacts (202*i*, 202*j*) of the second switch element 202 are opened, thereby cutting off connection between one side driving input of the DC motor 101 and the ground line 116.

Next, when the state shifts to the state shown in FIG. 19C, the two NC contacts (202*i*, 202*j*) of the second switch element 202 keep the open state, the closed state between the moving plate (201*g*) of the first switch element 201 and the NO contact (201*a*) is released and connection between the moving plate (201*g*) and the NC contact (201*c*) is closed. Finally, the state shifts to the state shown in FIG. 19D. Namely, both of the two NC contacts (202*i*, 202*j*) of the second switch element 202 are closed, the ground line 116 is connected to the one and other side driving inputs of the DC motor 101 and the rotation of the DC motor 101 stops.

As described above, the second prior art brings the second switch element 202 into the open state to cut off the route of the large current before, or simultaneously with, switching of the contacts of the first switch element 201. Therefore, the large current explained at the beginning (large current 129 in FIG. 15) does not flow and contact damage of the first switch element 201 can be avoided. Incidentally, because the NC contacts are added for two circuits, the width of the switch apparatus becomes somewhat greater. However, because the contact gap need not be increased, the switch apparatus 200 does not invite the drastic increase of the scale and deterioration of response performance. Furthermore, because the second switch element 202 is the NC contacts, the space of the NO contact can be utilized for increasing the contact gap.

[Non-Patent Reference 1]

"Toyota VITZ Wiring diagrams/SCP10 System (1999-1~)", Service Dept. Toyota Motors, Jan. 13, 1999, pp 3–38 to 3–39

SUMMARY OF THE INVENTION

As described above, the prior art (second prior art) according to the inventors of the invention is advantageous in that it can avoid contact damage without inviting the drastic increase of the scale of the switch unit even when it is applied to the high power source voltage such as the voltage of the 42 V electric system, but involves the following problems yet to be solved.

Referring to FIG. 18, recesses (lower surface recesses 203*b* and 203*c*) are formed in the lower surface of the operation means 203*a*. These lower surface recesses 203*b* and 203*c* are for one of the push buttons 202*p* of the second switch element 202. Incidentally, recesses for the other push button 202*n* of the second switch element 202 are also formed though they are not shown in the drawing.

When the knob 102 exists under the neutral state, the two push buttons 202*p* and 202*n* are inside the recesses (in the lower surface recess 203*b* in the case of the push button 202*p*). When the knob 102 is brought into the UP state, one of the push buttons 202*p* enters the lower surface recess 203*c* (recess adjacent to the lower surface recess 203*b*). Similarly, when the knob 102 is brought into the DOWN state, the other push button 202*n* enters the lower surface recess that is not shown in the drawing.

The point to be improved in the second prior art is that return feeling from the UP state (or DOWN state) to the neutral state is not good for the following reason. When the knob 102 exists under the UP state or the DOWN state, the two push buttons 202*p* and 202*n* exist inside the respective recesses (lower surface 203*c* in the case of one of the push buttons 202*p*). Therefore, they need "force" to come out from the recesses to return to the neutral state and "catch" feeling is imparted to the operation of the knob 102.

To eliminate this "catch" feeling, it may be possible to increase the spring force of the spring 104 buried inside the knob 102, or to drive the moving plates 201*g* and 201*h* of the first switch element 201 on each side (by devising the recess shape of the switching operation element 203 so that only connection between the fixed contact 202*j* and the moving contact 202*f* of the second switch element 202 is opened after connection between the fixed electrodes 201*d* and 201*e* is closed under the UPstate), for example. According to such means, however, large operation force exceeding the spring force of the spring 104 becomes necessary when the knob 102 is operated from the neutral state to the UP state (or to the DOWN state), and operation feeling of the knob 102 gets deteriorated, as well, or "catch" feeling can be reduced only half. Therefore, they do not render the fundamental solution.

It is therefore an object of the invention to provide a switch apparatus that (A) can avoid contact damage without inviting the drastic increase of the scale of the switch unit even when applied to a high power source voltage such as a voltage of the 42 V electric system and moreover (B) does not deteriorate return feeling to the neutral state.

According to an aspect of the invention, there is provided a switch apparatus for causing a DC motor to stop and rotate normally or reversely by switching a connection state of one side driving input and the other side driving input of the DC motor, a positive plate side power source and a negative plate side power source, comprising a switch A for cutting off connection between the one side driving input of the DC motor and the negative plate side power source; a switch B for cutting off connection between the other side driving input of the DC motor and the negative plate side power source; and a switch C for cutting off connection between the one side driving input of the DC motor and the positive plate side power source and connection between the other side driving input of the DC motor and the positive plate side power source; wherein the switch A and the switch B are normally-closed type switches, the switch C is a normally-open type switch, and the switch C is opened at a predetermined time before the switch A or the switch B is closed.

Here, the invention can use an embodiment wherein the switches A and b are normally-open type switches. Alternatively, the invention can use another embodiment wherein the switch C is constituted by use of two sets of switches.

In the invention, when the switch A or B is brought into the closed state, the switch C is brought into the open state at a predetermined time before closing of the switch A or B and cuts off in advance the power source route. The problem of dead short-circuit can thus be eliminated. When a slide type structure is employed for the switch C, return feeling of the switch C from the closed state to the open state can be improved.

BRIEF DECRIPION OF THE DRAWINGS

DESCRIPTION OF THE PREFERRED EMBODIMENTS

Preferred embodiments of the invention will be explained hereinafter with reference to the accompanying drawings.

Figure 1:
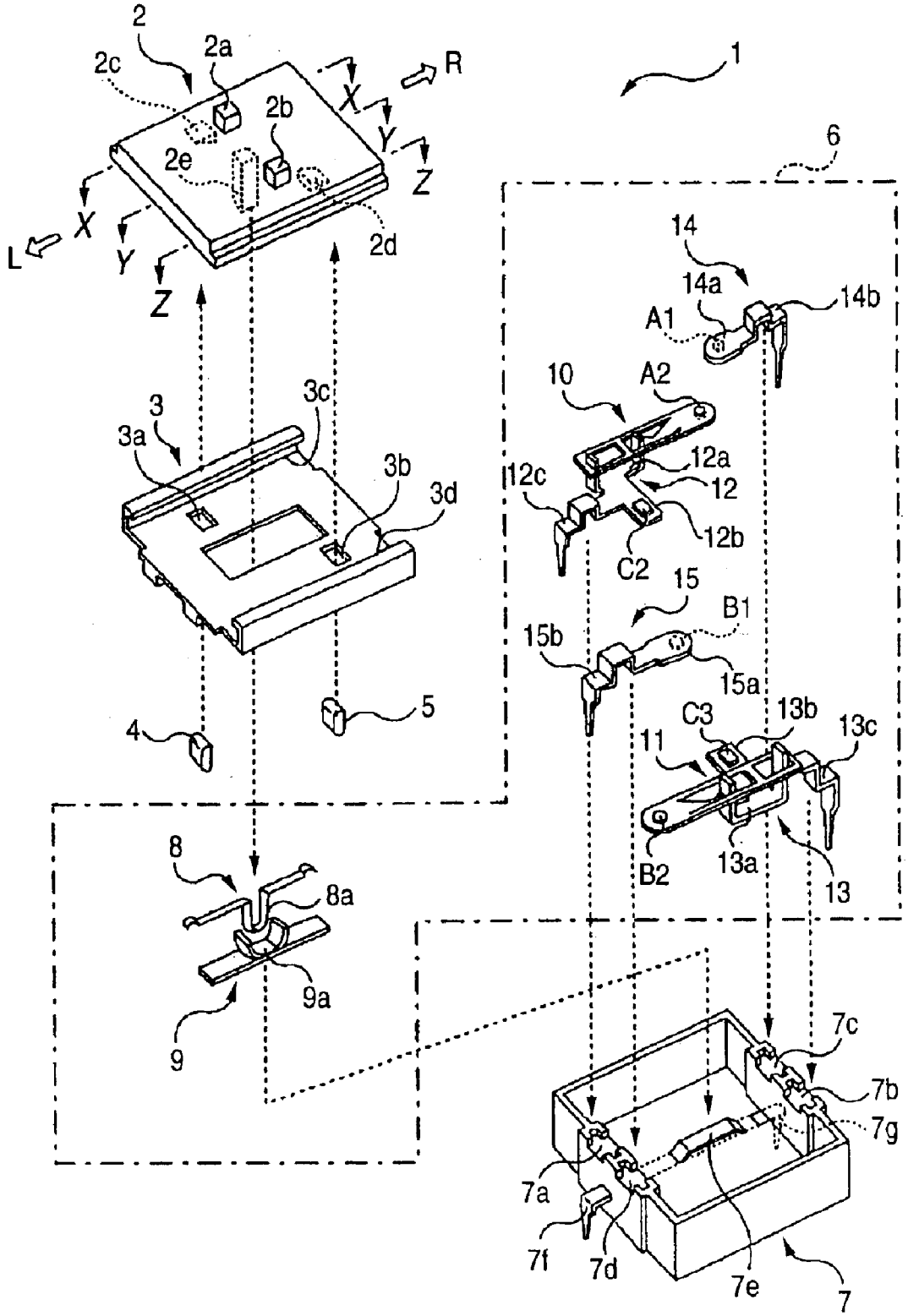
FIG. 1 is an exploded view of a switch apparatus 1 according to an embodiment of the invention.

FIG. 1 is an exploded view of a switch apparatus according to an embodiment of the invention. The switch apparatus 1 includes from above to below in the drawing a slider 2, a slide rail/upper lid (hereinafter merely called "upper lid") 3, two push buttons 4 and 5, a contact mechanism 6 and a casing 7. This switch apparatus 1 is assembled in the following way. The contact mechanism 6 that is constituted into a sub-assembly is assembled into the casing 7. An upper surface opening of the casing 7 is then closed with the upper lid 3, and the two push buttons 4 and 5 and the slider 2 are fitted to the upper lid 3.

Figure 10A:
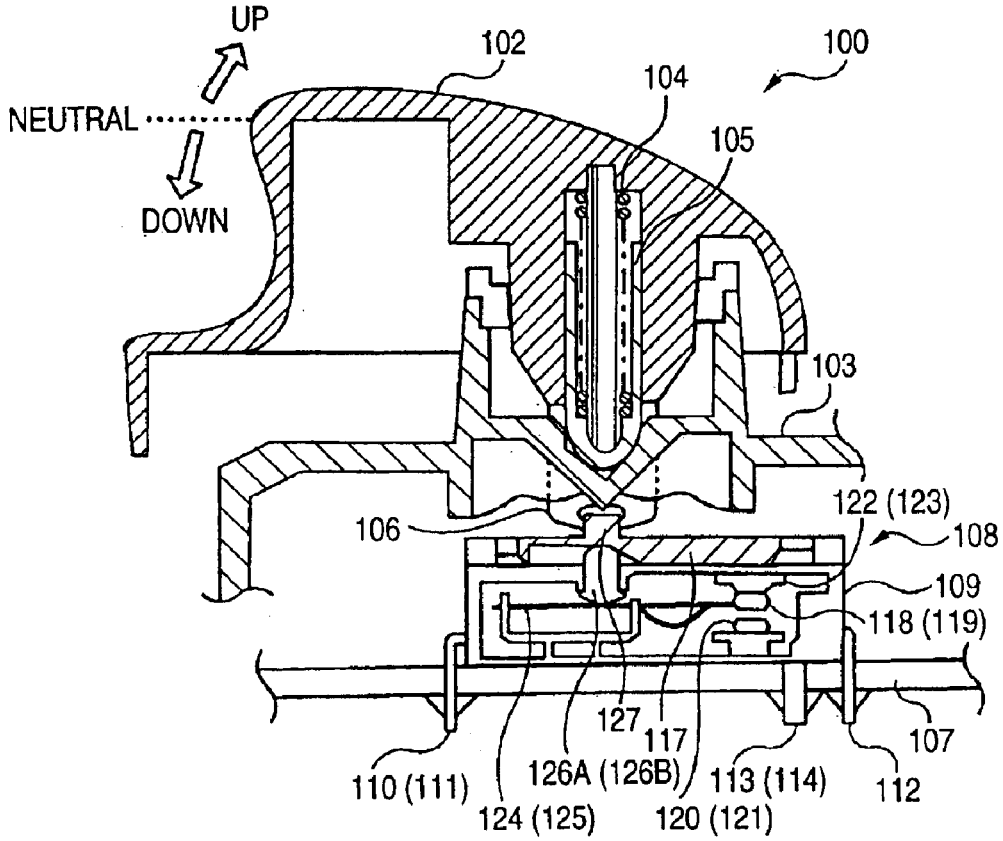
FIG. 10 is a structural view of a switch apparatus according to a first prior art and its circuit diagram (under a neutral state)
Figure 10B:
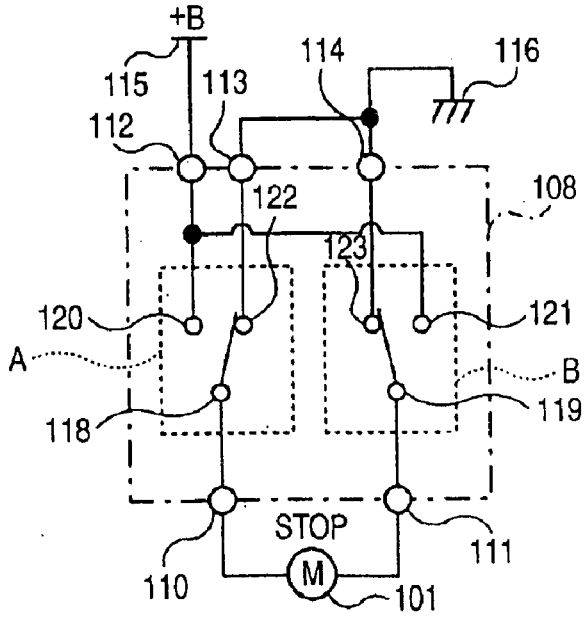
Figure 11A:
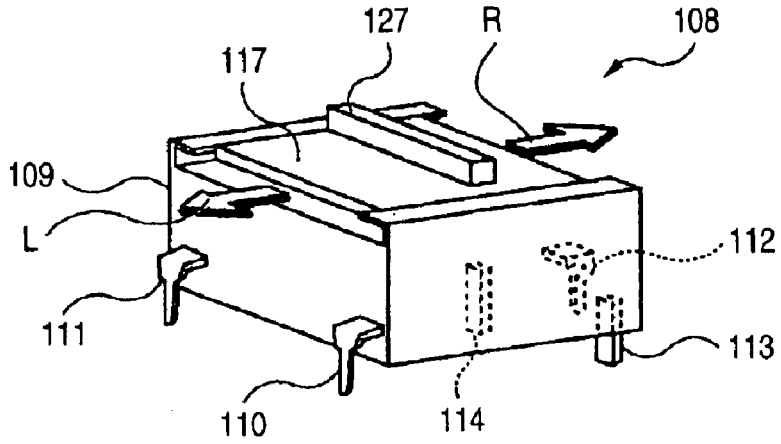
FIG. 11 is an appearance view of a switch unit 108 in the first prior art, and plan and sectional views of a slider 117.
Figure 11B:
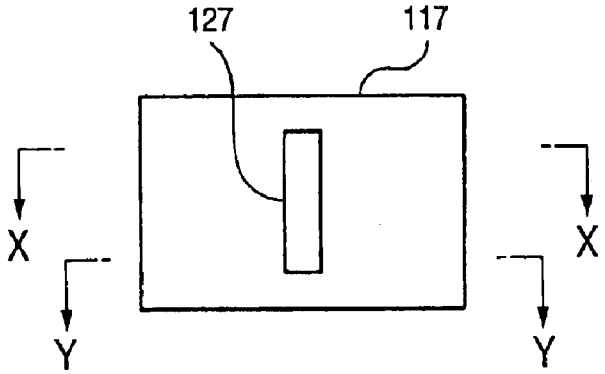
Figure 11C:
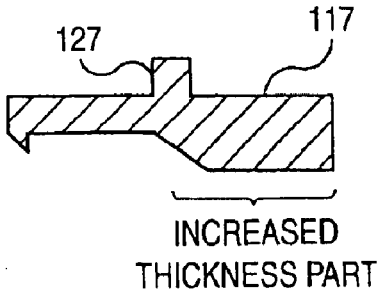
Figure 11D:
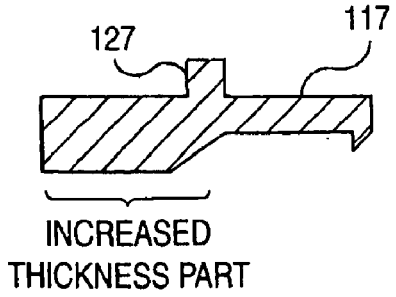
Figure 12A:
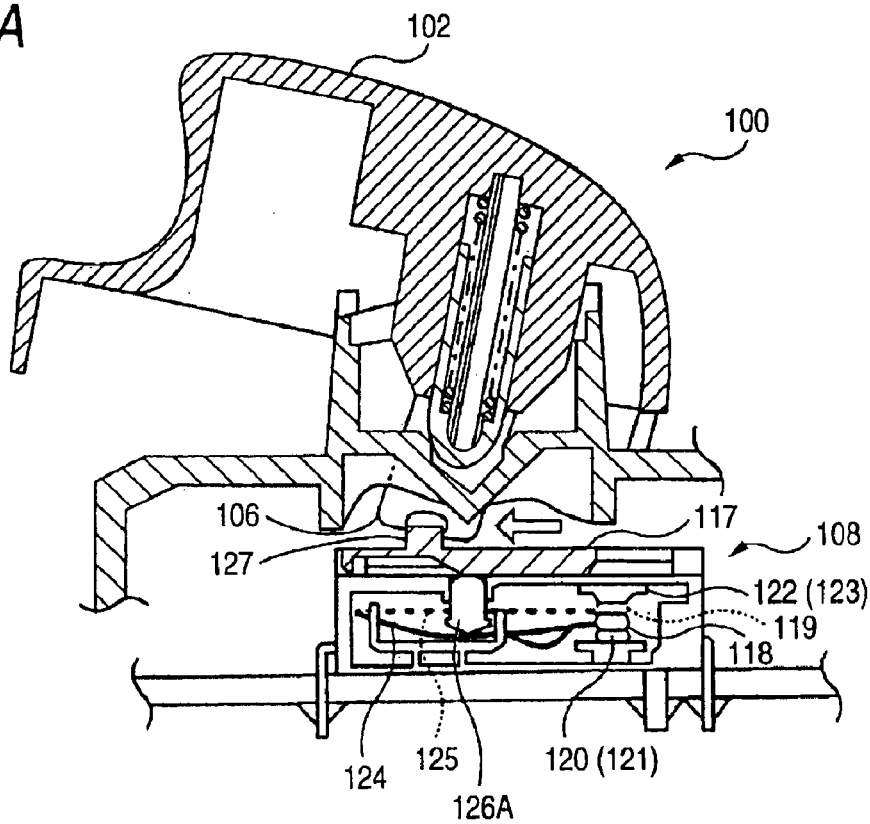
FIG. 12 is a structural view of the switch apparatus according to the first prior art and its circuit diagram (under an UP state)
Figure 12B:
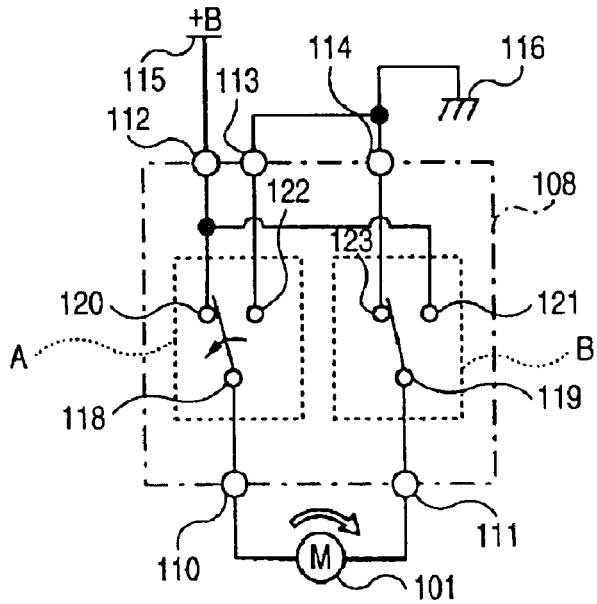
Figure 13:
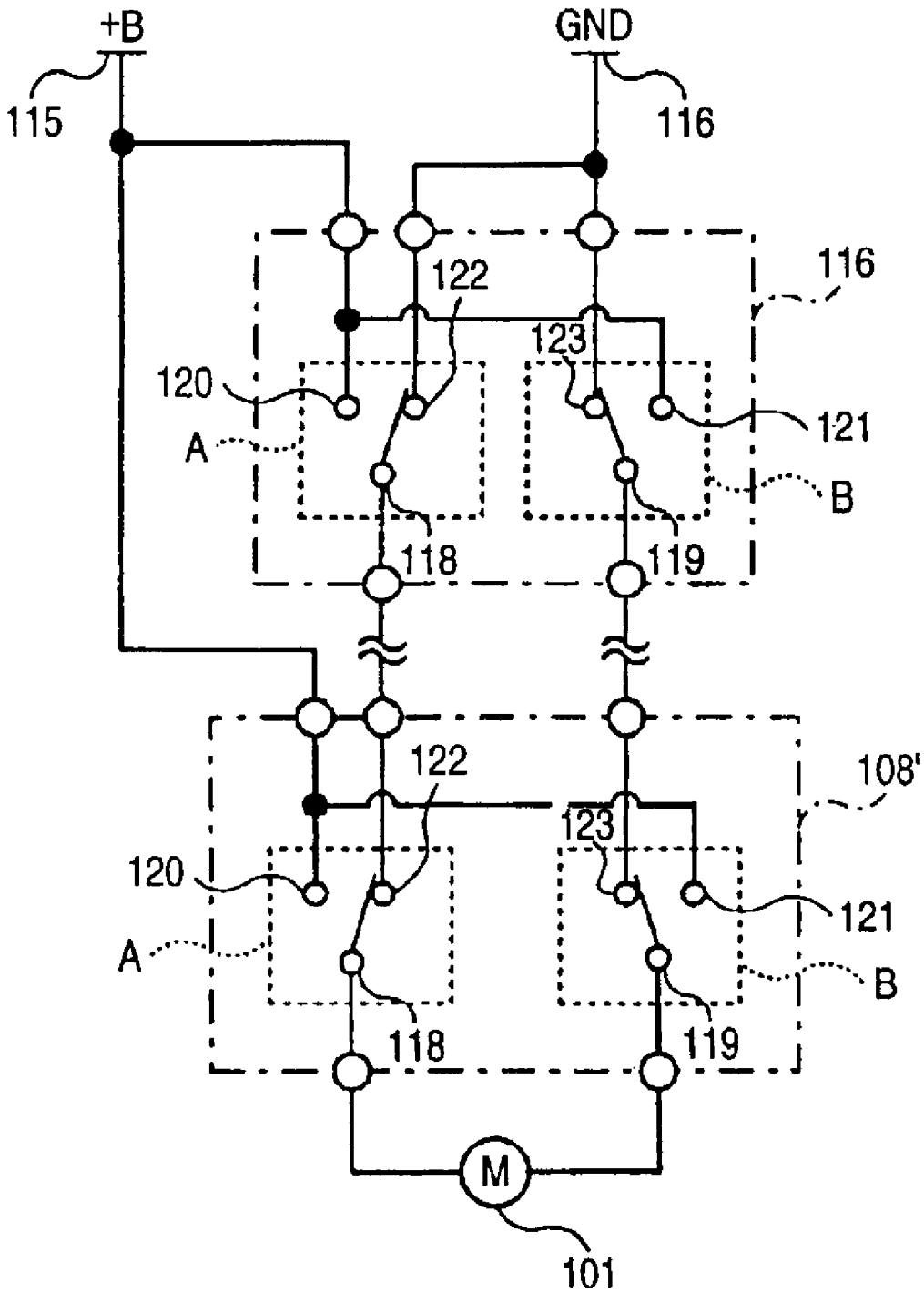
FIG. 13 is circuit diagram of a switch apparatus of a type capable of opening and closing windows of other seats from a driver's seat.
Figure 14:
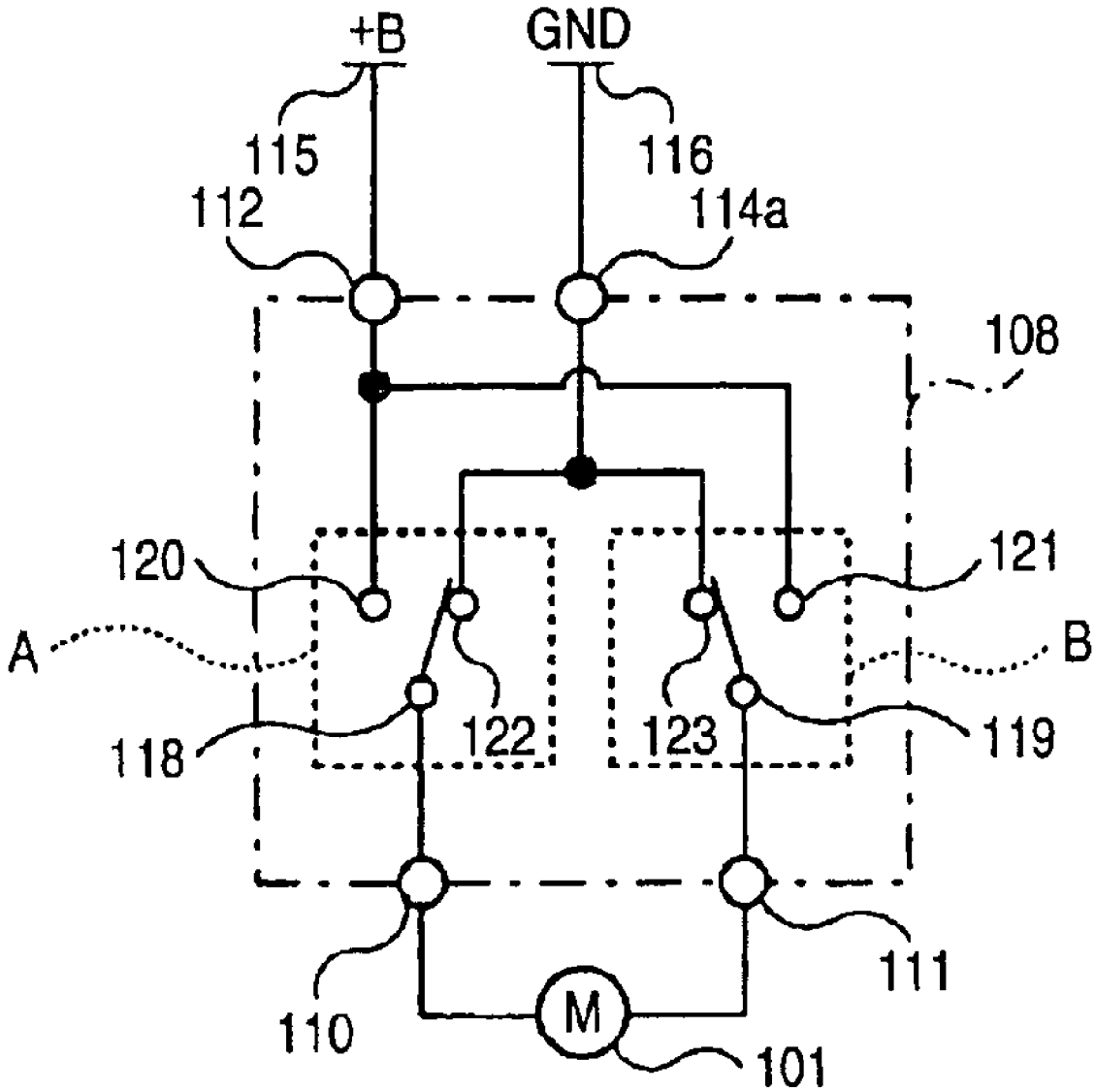
FIG. 14 is a circuit diagram of a switch apparatus having four terminals in total.
Figure 15A:
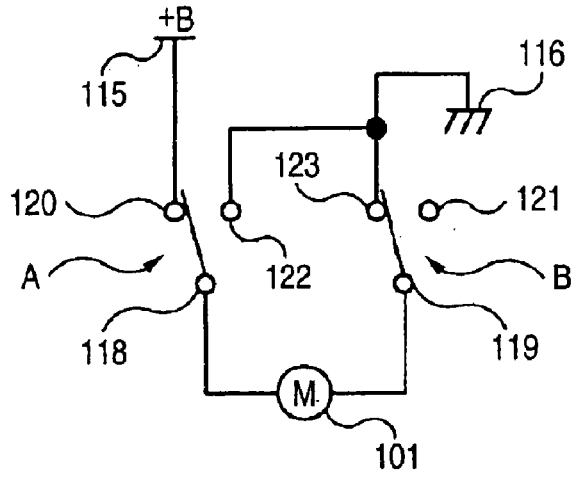
FIG. 15 is an explanatory view of contact damage.
Figure 15B:
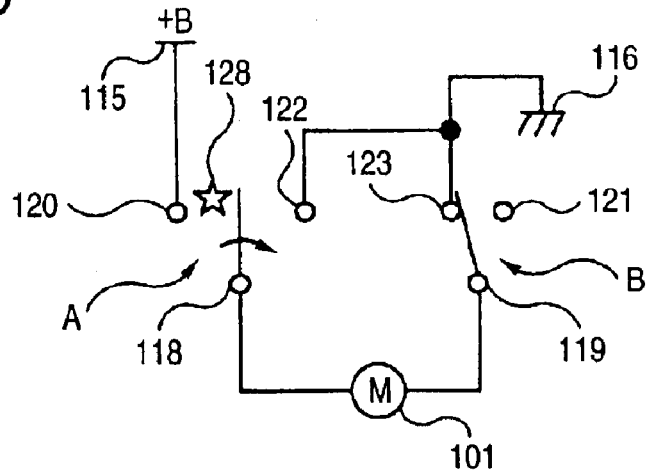
Figure 15C:
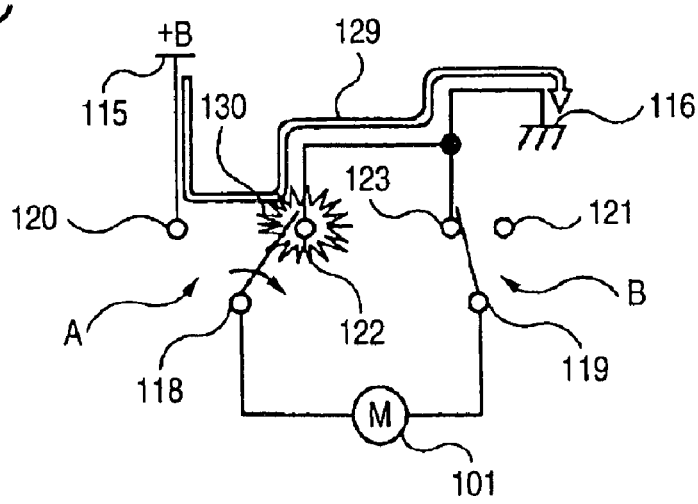
Figure 16:
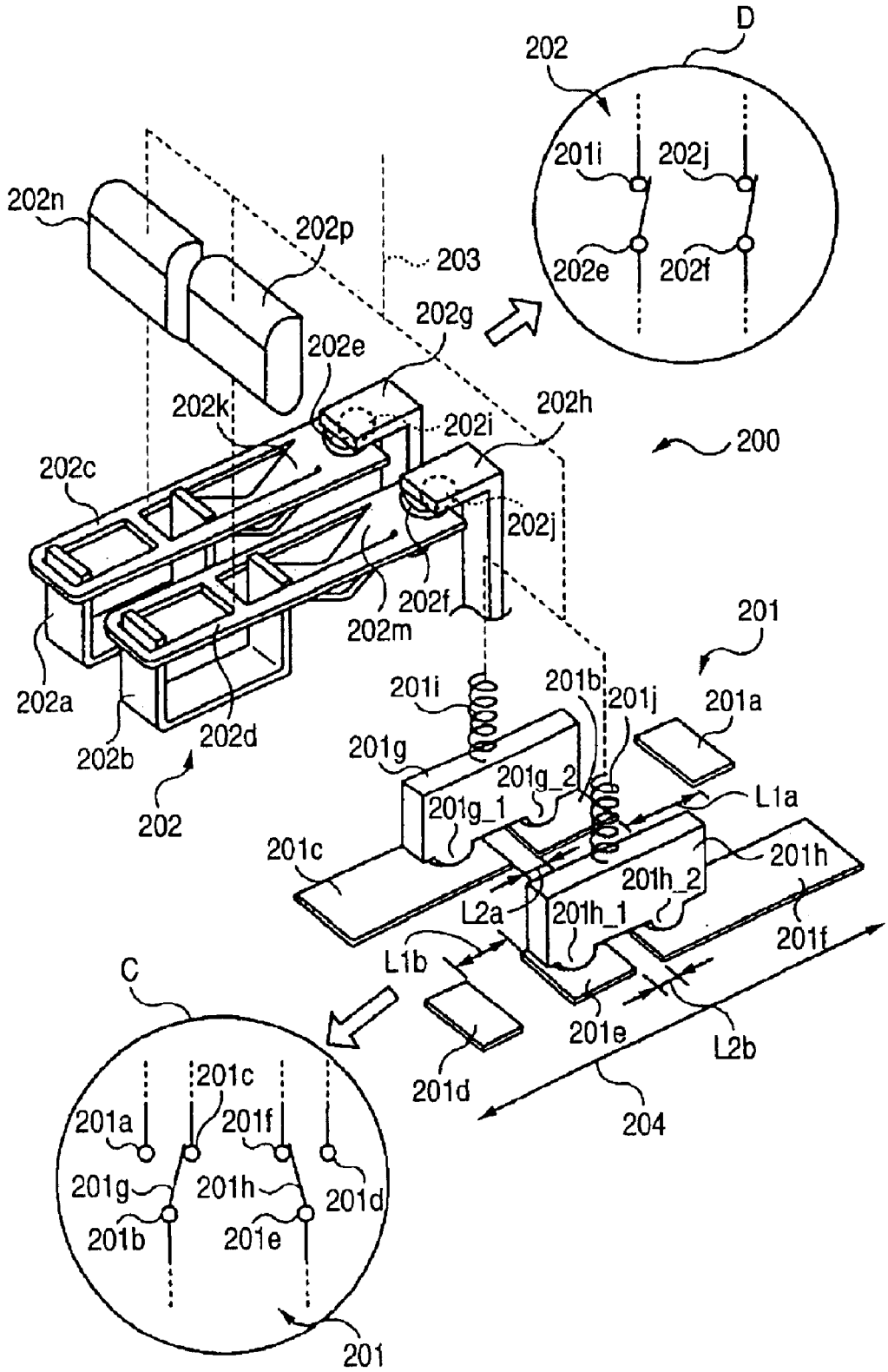
FIG. 16 is a structural view of principal portions of a switch apparatus 200 according to a second prior art.
Figure 17:
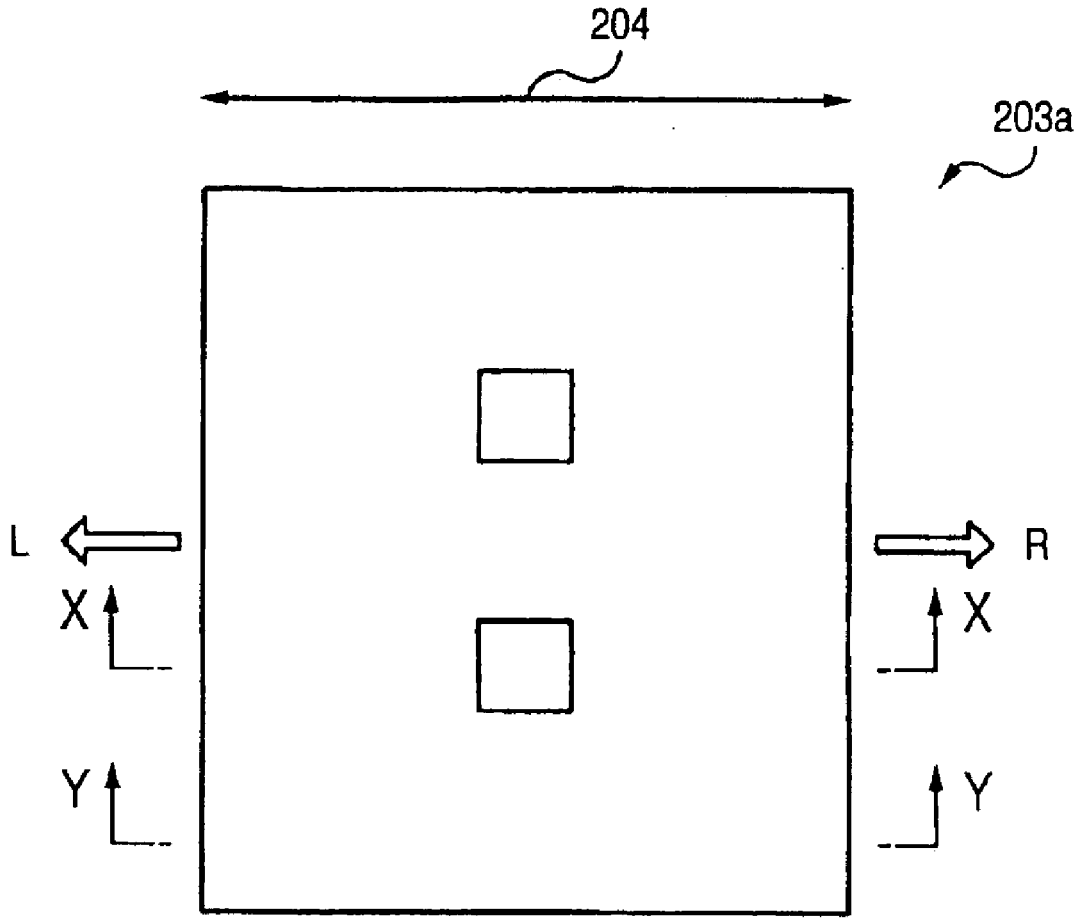
FIG. 17 is a plan view of a slider 117 in the second prior art.
Figure 18:
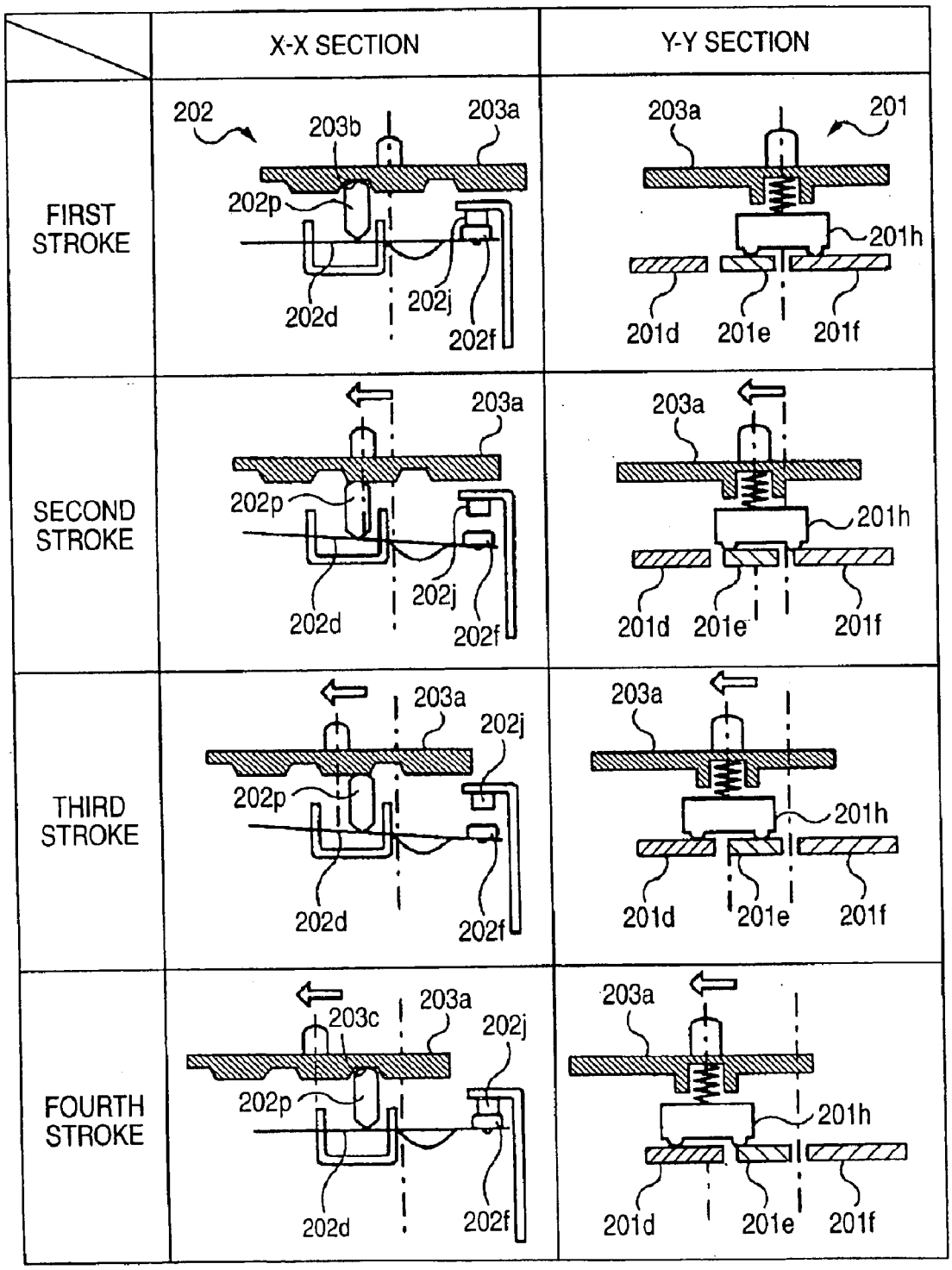
FIG. 18 is an explanatory view of a function of a switching operation element 203 in the second prior art.
Figure 19A:
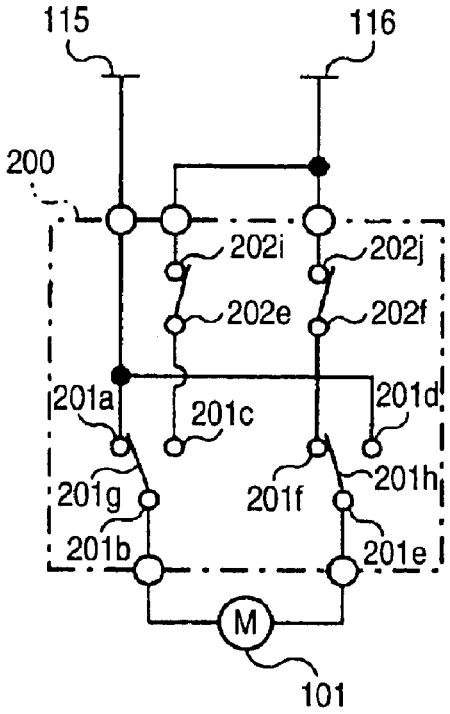
FIG. 19 is a circuit diagram of a rotation (normal/reverse rotation)/stop system of a window opening/closing DC motor constituted by the application of the switch apparatus 200 according to the second prior art.
Figure 19B:
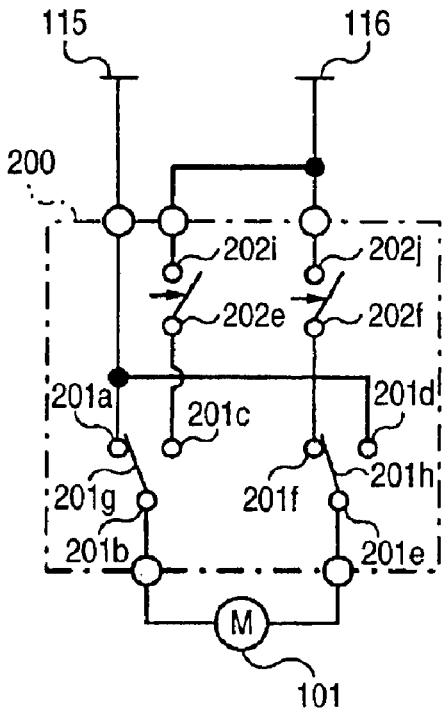
Figure 19C:
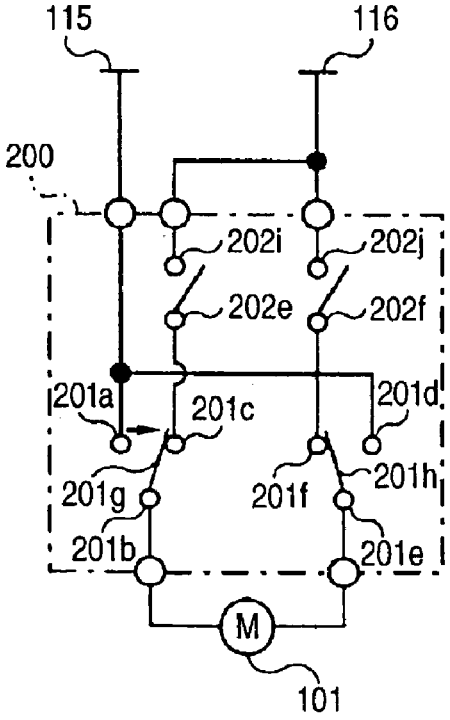
Figure 19D:
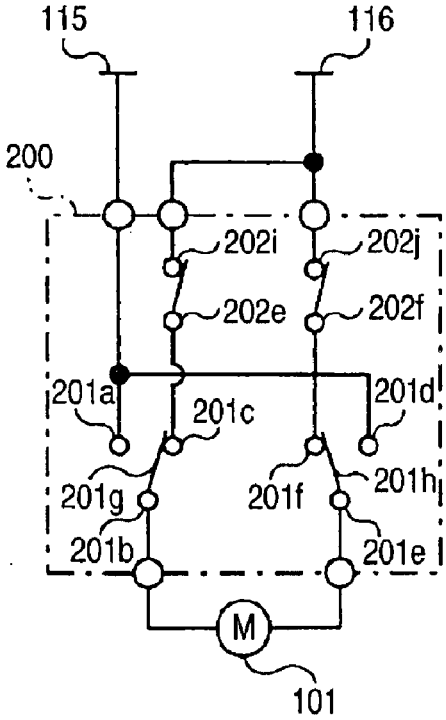

The upper lid 3 has insertion holes 3*a* and 3*b* for the push buttons 4 and 5 and slide rail portions 3*c* and 3*d* for holding the slider 2 in such a manner as to be capable of sliding in L and R directions in the drawing. Protuberances 2*a* and 2*b* corresponding to the upper protuberance 127 of the slider 117 in the prior art (see FIG. 10) are provided to the upper surface of the slider 2. These protuberances 2*a* and 2*b* can engage with the distal end of the lower protuberance 106 of the knob 102 shown in FIG. 10(*a*), for example, and the slider 2 slides to the right and left (L/R direction in the drawing) while following the rocking motion of the lower protuberance 106 of the knob 102 in a transverse direction (UP and DOWN states). Two protuberances 2*c* and 2*d* each having a slope and a columnar protuberance 2*e* are provided to the lower surface of the slider 2.

Here, X—X, Y—Y and Z—Z in the drawing represent three sectional directions of the slider 2. These sections are in parallel with the moving direction (L/R direction) of the slider 2 and cut off the two protuberances 2*c* and 2*d* having a slope and one columnar protuberance Ze. In other words, one of the protuberances 2*c* having the slope is positioned on the X—X sectional plane and the other protuberance 2*d* having the slope, on the Z—Z sectional plane. The columnar protuberance 2*e* is positioned on the intermediate Y—Y sectional plane.

Figure 2A:
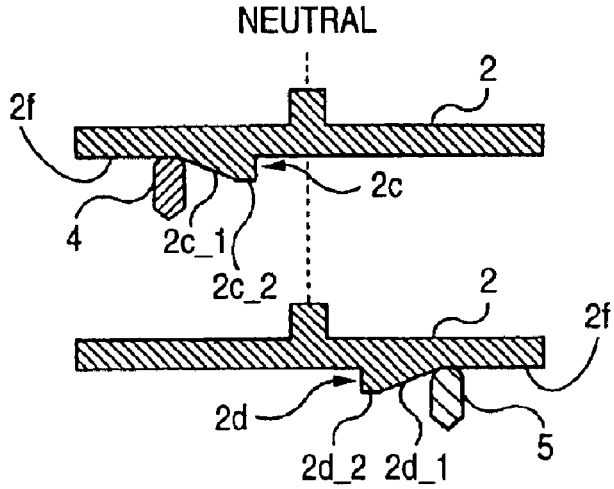
FIG. 2 is a sectional view of a slider taken along a line X—X and along a line Z—Z.
Figure 2B:
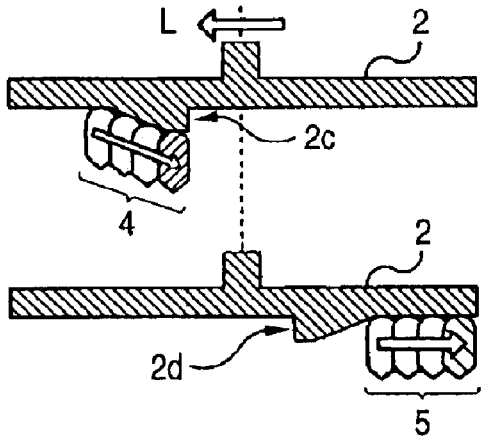
Figure 2C:
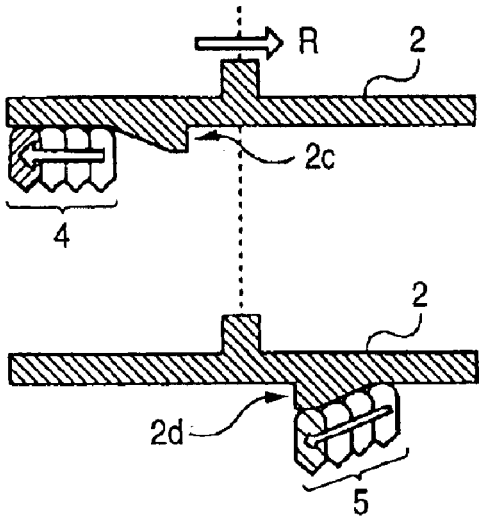

FIGS. 2A to 2C show the X—X sectional plane of the slider 2 and its Z—Z sectional plane, wherein FIG. 2A represents the state where the slider 2 is neutral and FIGS. 2B and 2C represent the state where the slider 2 is moved in the L direction (UP state) and in the R direction (DOWN state), respectively.

In FIG. 2A, one of the protuberances 2*c* having the slope (hereinafter called "first protuberance with the slope") has a slope 2*c*_1 inclining downward to the right for pushing down the push button 4 and a flat surface 2*c*_2 continuing the former. The other protuberance 2*d* having the slope (hereinafter called "second protuberance with the slope") has a slope 2*d*_1 inclining downward to the left for pushing down the push button 5 and a flat surface 2*d*_2 continuing the former.

When the slider 2 is under the neutral state, both push buttons 4 and 5 keep contact with the lower surface 2*f* of the slider 2. When the slider 2 is slid in the L direction as shown in FIG. 2B, one of the push buttons 4 is gradually pushed down in the drawing while keeping contact with the slope 2*c*_1 of the first protuberance 2*c* with the slope and reaches finally the contact position (the lowermost position) with the flat surface 2*c*_2. The other push button 5 keeps its position (the uppermost position) while keeping contact with the lower surface 2*f* of the slider 2. When the slider 2 is slid in the R direction as shown in FIG. 2C, the other push button 5 comes into contact with the slope 2*d*_1 of the second protuberance 2*d* with the slope, is gradually pushed down in the drawing and reaches finally the contact position (the lowermost position) with the flat surface 2*d*_2. One of the push buttons 4 keeps its position (the uppermost position) while keeping contact with the lower surface 2*f* of the slider 2.

Turning back again to FIG. 1, the contact mechanism 6 includes a flexible member 8 having at its center a U-shaped portion 8*a*, a flat sheet-like moving plate 9 made of a highly conductive and rigid material and having a seat portion 9*a* for seating the U-shaped portion 8*a* of the flexible member 8, two leaf spring type moving plates 10 and 11 made of a metal, common terminal members 12 and 13 for each of these metal leaf spring type moving plates 10 and 11, two normally-closed contact terminal members 14 and 15, and a metal wiring 7*e* assembled into the casing 7.

The center part of the metal wiring 7*e* is higher from the bottom surface of the casing 7 and the flexible member 8 is put on the center part. One of the ends of the metal wiring 7*e* is connected to a terminal 7*f* disposed on one of the side surfaces of the casing 7 and the other end of the mental wiring is connected to a terminal 7*g* disposed on the other side surface of the casing 7. The terminals 7*f* and 7*g* are used for leading out the metal wiring 7*e* and only one of them may well be disposed. When the terminals 7*f* and 7*g* are extended from both side surfaces of the casing 7 as shown in the drawing, however, the convenient one of them (either of the terminals 7*f* and 7*g*) can be used selectively and advantageously in consideration of interference with other components and extension of the wiring when the switch apparatus 1 is mounted to the car.

The common terminal members 12 and 13 are made of a highly conductive material. Each of them includes a holding portion 12*a*, 13*a* for holding discretely the metal leaf spring type moving plate 10, 11, an electrode formation portion 12*b*, 13*b* having a contact C2, C3 and a terminal 12*c*, 13*c* fitted to the terminal engagement portion 7*a*, 7*b* of the casing 7. Each of the normally-closed contact terminal members 14 and 15 has an electrode formation portion 14*a*, 15*a* having a contact A1, B1 and a terminal 14*b*. 15*b* fitted to the terminal engagement portion 7*c*, 7*d* of the casing 7.

The two metal leaf spring type moving plates 10 and 11 are made of a highly conductive and flexible material such as a metal, and the contacts A2 and B2 are respectively fitted to their distal ends. These metal leaf spring type moving plates 10 and 11 undergo plastic deformation when the afore-mentioned push buttons 4 and 5 are pushed down, and switch the connection of each contact.

Figure 3A:
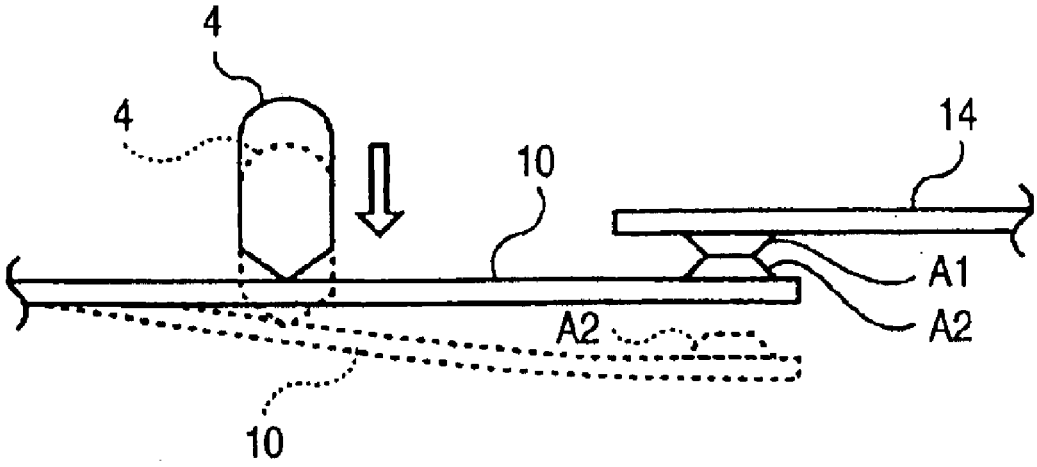
FIG. 3 is a view showing a contact switching state of two metal leaf spring type moving plates 10 and 11.
Figure 3B:
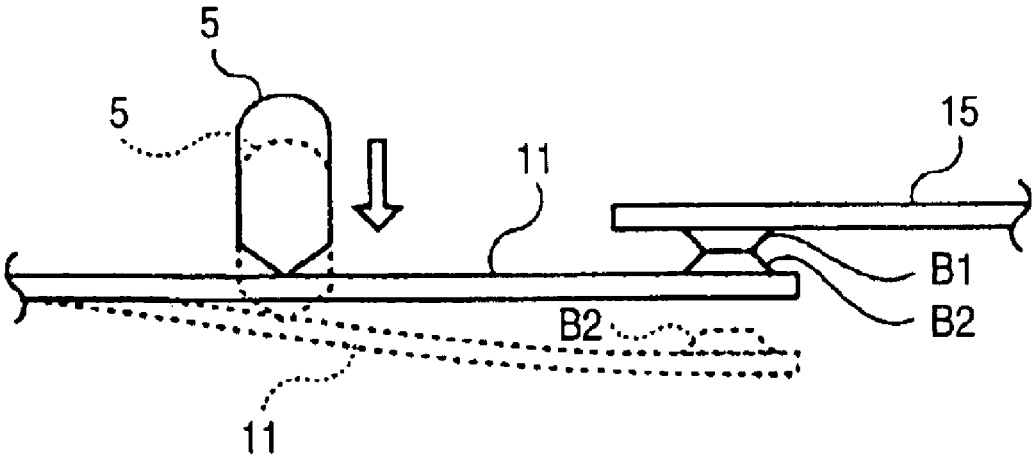

FIGS. 3A and 3B show contact switch state diagrams of the two metal leaf spring type moving plates 10 and 11. In FIG. 3A, the metal leaf spring type moving plate 10 normally closes the contacts A1 and A2. When this moving plate 10 undergoes plastic deformation in response to the pushdown operation of the push button 4, however, it opens connection between the contacts A1 and A2. In FIG. 3B, the metal leaf spring type moving plate 11 normally closes connection between the contacts B1 and B2. When this moving plate 11 undergoes plastic deformation in response to the pushdown operation of the push button 5, however, it opens connection between the contacts B1 and B2. Therefore, the contacts A1 and A2 and the contacts B1 and B2 constitute a normally-closed contact (NC contact) that are normally closed. The normally-closed switch constituted by the contacts A1 and A2 will be hereinafter called switch A" and the normally-closed switch constituted by the contacts B1 and B2 will be hereinafter called "switch B" for the sake of explanation. Though the prior art uses the same term of the switch (switches A and B), the switches A and B in the embodiment of the invention has no relation with the term of the switch used in the prior art.

In the embodiment of the invention, a third switch (called "switch C") that will be explained next is employed in addition to the switches A and B described above.

Figure 4:
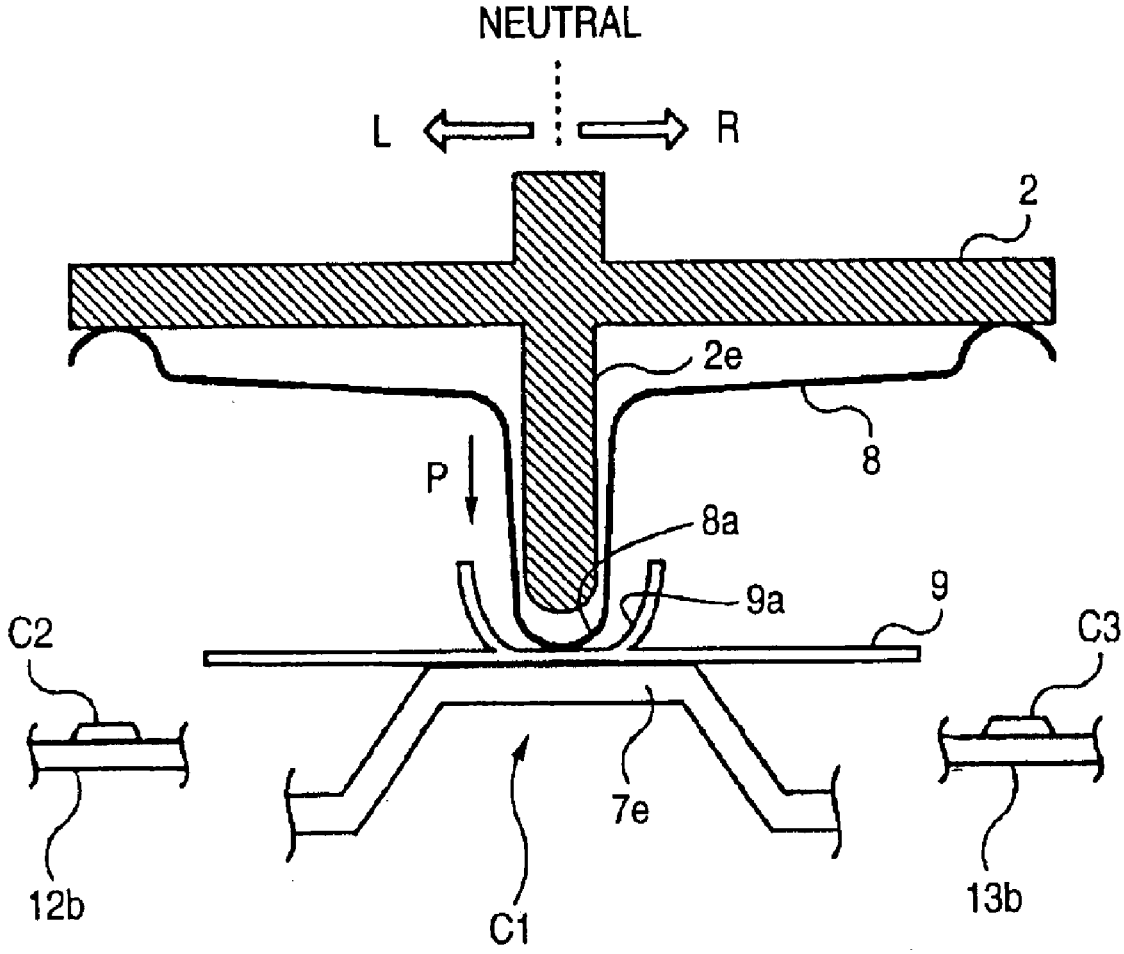
FIG. 4 shows a structure of a switch C.
Figure 5A:
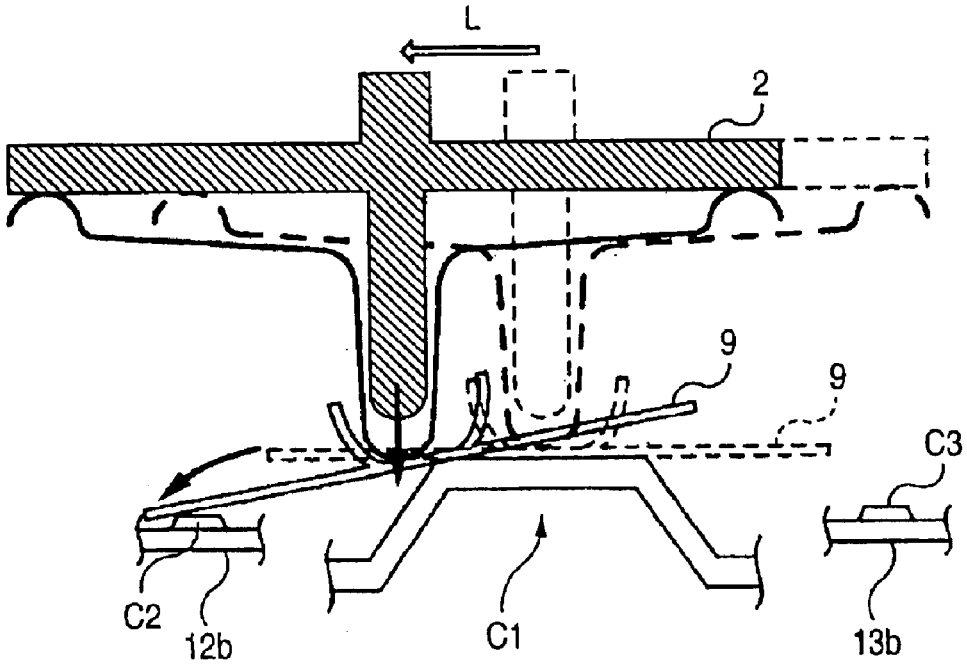
FIG. 5 shows a switching state of the switch C.
Figure 5B:
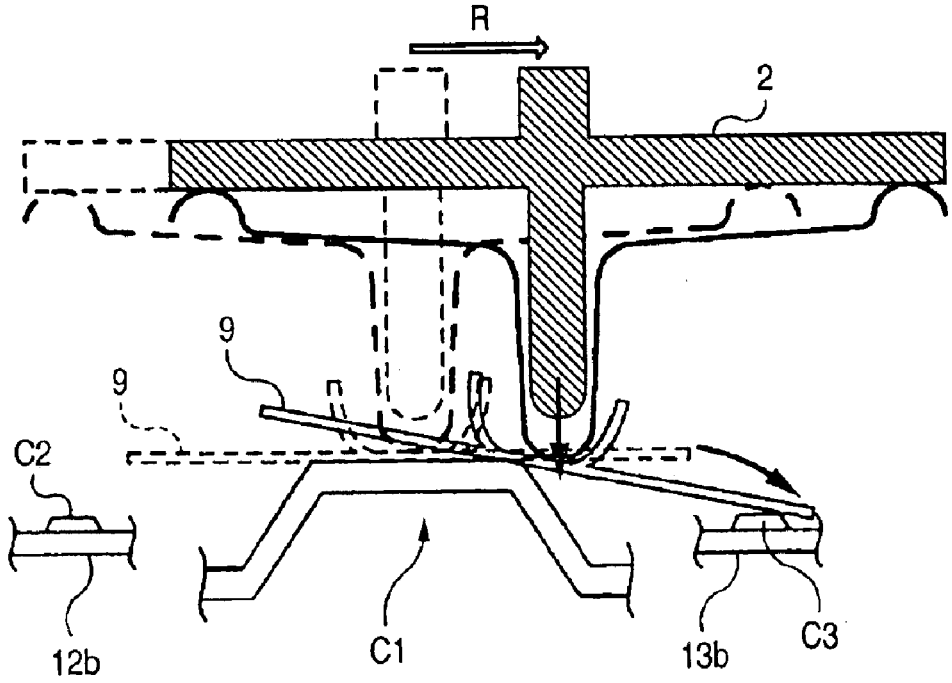

FIG. 4 shows the structure of the switch C. The flexible member 8 keeps contact with the lower surface of the slider 2. The flexible member 8 exhibits urging force P that pushes down the U-shaped portion 8*a* in the drawing and this urging force P restricts free movement of the flat sheet-like moving plate 9 interposed between the flexible member 8 and the metal wiring 7*e*. The contact C2 provided to the electrode formation portion 12*b* is arranged at a position a little spaced apart from the flat sheet-like moving plate 9 on one of its sides (on the left side in the drawing) and the contact C3 provided to the electrode formation portion 13*b* is arranged at a position a little spaced apart from the flat sheet-like moving plate 9 on the other side (on the right side in the drawing). When the slider 2 is under the neutral state (shown in the drawing) in this construction, the flat sheet-like moving plate 9 is left put as such on the metal wiring 7*e*. When the slider 2 is moved in the L or R direction, the flat sheet-like moving plate 9 slides and falls from the left end (or the right end) of the metal wiring 7*e* and comes into contact with the contact (C2 or C3) positioned on the same side as shown in FIGS. 5A and 5B.

Here, the flat sheet-like moving plate 9 and the metal wiring 7*e* are unitarily called "contact C1". The time from the start of movement of the slider 2 in the L or R direction to the contact time with the contact (C2 or C3) is called "close delay time Td_Close". Further, the point at which the flat sheet-like moving plate 9 leaves the contact (C2 or C3) and the return time of the slider 2 to its neutral state is called "open delay time Td_Open" for convenience sake. Then, the contacts C1, C2 and C3 constitute a "switch C" that operates in the following way.

(1) All the contacts are open (normally open) when the slider 2 is under the neutral state.
(2) When the slider 2 moves in the L direction, the contacts C1 and C2 are closed after the close delay time Td_Close described above.
(3) When the slider 2 moves in the R direction, the contacts C1 and C3 are closed after the close delay time Td_Close described above.
(4) When the slider 2 is returned to the neutral state from the movement state in the L or R direction (UP state or DOWN state), the contact C1 is opened prior to switching of the contacts of the switch A and the switch B.

Figure 6:
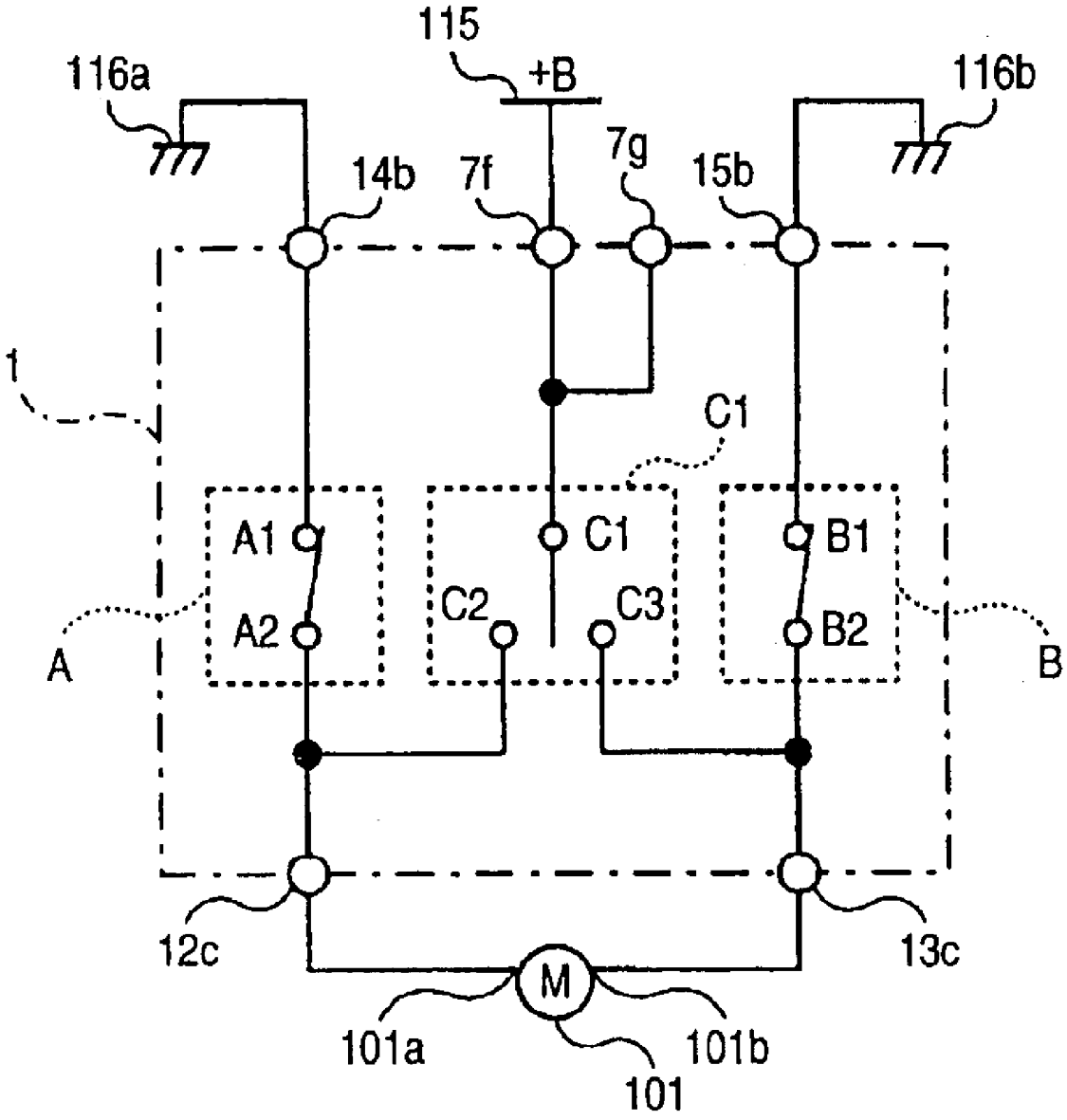
FIG. 6 is a circuit diagram of the switch apparatus 1.

FIG. 6 is a circuit diagram of the switch apparatus 1 having the construction described above. The switch apparatus 1 is used for rotating and stopping the DC motor for opening and closing the windows of vehicles such as automobiles.

The switch apparatus 1 includes each of the switches A to C described above. The switch A includes the contacts A1 and A2, the switch B includes the contacts B1 and B2 and the switch C includes the contacts C1, C2 and C3.

As shown in the drawing, the contact A1 of the switch A is connected to a power source on a negative plate side (potential of a ground wire 116*a*: 0 V) through a terminal 14*b*, and the contact B1 of the switch B is connected to a power source on the negative plate side (potential of a ground wire 116*b*: 0 V) through the terminal 15*b*. The contact C1 of the switch C is connected to a power source on the positive plate side (potential of a +B line 115: +42 V) through the terminal 7*f* (or the terminal 7*g*) and the contacts C2 and C3 of the switch C are electrically connected to the contact A2 of the switch A and to the contact B2 of the switch B. Furthermore, the contact A2 of the switch A (and the contact C2 of the switch C) is connected to one of the driving inputs 101*a* of a DC motor 101 through the terminal 12*c* and the contact B2 of the switch B (and the contact C3 of the switch C) is connected to the other driving input 101*b* of the DC motor 101 through the terminal 13*c*.

Referring to FIG. 6, the contact positions of the switches A, B and C shown in the drawing represent the state where the push buttons 4 and 5 are not pushed down (that is, when the slider 2 is under the neutral state: see FIG. 2A). Under this state, the negative plate side power source is applied to one of the driving inputs 101*a* of the DC motor 101 through the route of the ground line 116*a*→terminal 14*b*→contact A1 of switch A→contact A2 of switch A→terminal 12*c* while the negative plate side power source is applied to the other driving input 101*b* of the DC motor 101 through the route of the ground line 116*b*→terminal 15*b*→contact B1 of switch B→contact B2 of switch B→terminal 13*c*. In this case, the DC motor 101 is at halt.

When the slider 2 is moved in the L direction (see FIG. 2B), on the other hand, the push button 4 moves down and connection between the contacts A1 and A2 of the switch A are opened with the movement of the push button 4. The push button 5 does not yet move down at this time and connection between the contacts B1 and B2 of the switch B remain closed. The flat sheet-like moving plate 9 starts sliding with the movement of the slider 2 in the L direction and connection between the contacts C1 and C2 of the switch C are closed after the predetermined close delay time Td_Close (see FIG. 5A). Consequently, the positive plate side power source is applied to one of the driving inputs 101*a* of the DC motor 101 through the route of the +B line 115→terminal 7*f*→contact C1 of switch C→contact C2 of switch C→terminal 12*c* while the negative plate side power source is applied to the other driving input 101*b* of the DC motor 101 through the route of the ground line 116*b*→terminal 15*b*→contact B1 of switch B→contact B2 of switch B→terminal 13*c*. In this case, the DC motor 101 rotates in the normal direction and the windows are driven and closed.

On the other hand, when the slider 2 is moved in the R direction (see FIG. 2C), the push button 5 moves down and connection between the contacts B1 and B2 of the switch B is opened with the movement of the push button 4. The push button 4 does not move down at this time and connection between the contacts A1 and A2 of the switch A remains closed. The flat sheet-like moving plate 9 starts sliding with the movement of the slider 2 in the R direction and connection between the contacts C1 and C3 of the switch C is closed after the predetermined close delay time Td_Close (see FIG. 5B). Consequently, the positive plate side power source is applied to the other driving input 101*b* of the DC motor 101 through the route of the +B line 115→terminal 7*f*→contact C1 of switch C→contact C3 of switch C→terminal 13*c* while the negative plate side power source is applied to one of the driving inputs 101*a* of the DC motor 101 through the route of the ground line 116*a*→terminal 14*b*→contact A1 of switch A→contact A2 of switch A→terminal 12*c*. In this case, the DC motor 101 rotates in the reverse direction and the windows are driven and opened.

Figure 7:
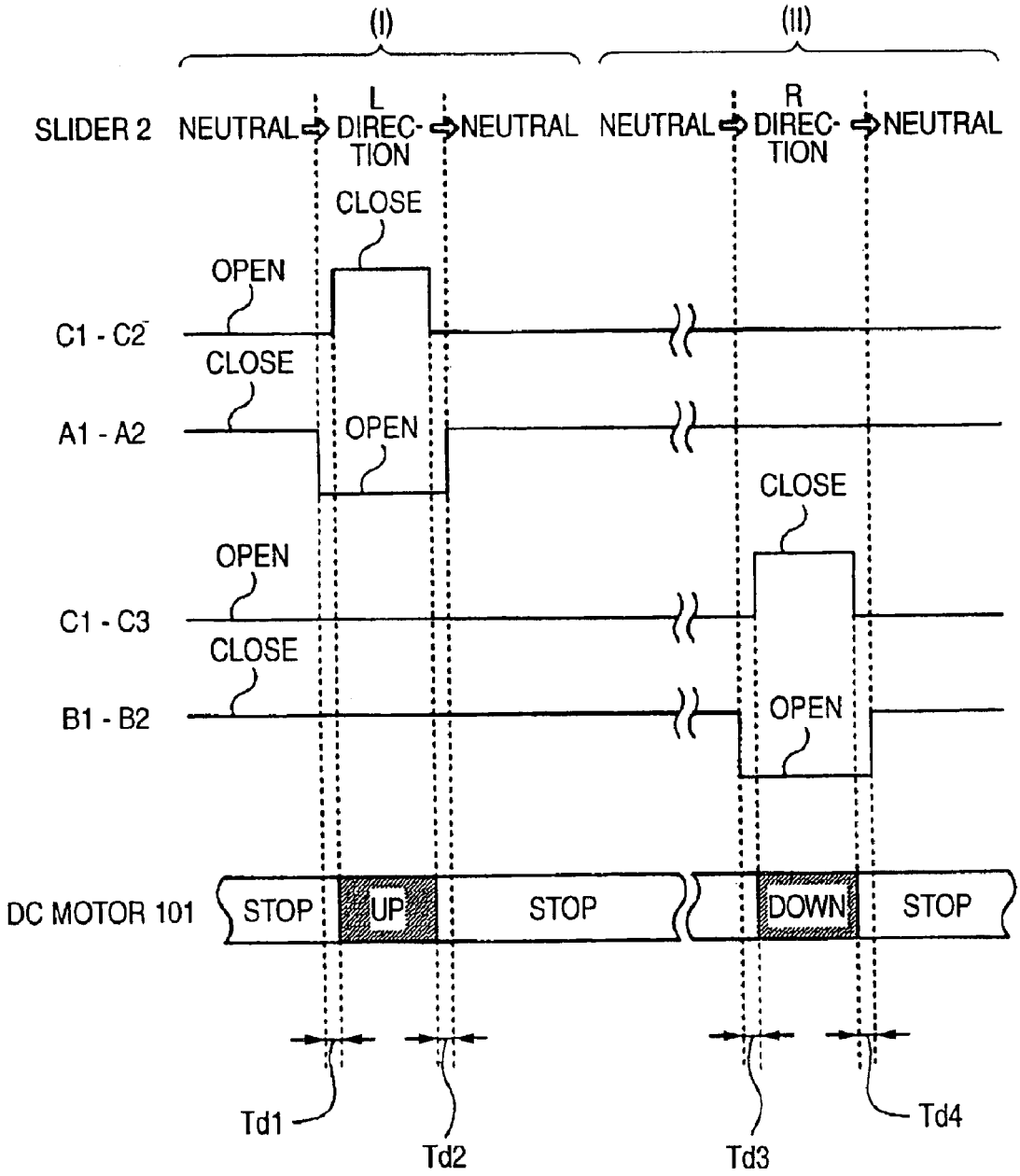
FIG. 7 is a diagram showing correspondence of state between a contact-switching operation of switches A, B and C and a stop/rotation operation of a DC motor 101.

FIG. 7 is a state correspondence diagram between the contact switch operation of the switches A, B and C and the stop/rotation operation of the DC motor 101. More specifically, (I) shows the state diagram when the slider 2 is moved from the neutral state in the L direction and is again returned to the neutral state, and (II) shows the state when the slider 2 is moved from the neutral state in the R direction and is again returned to the neutral state.

Referring to (I), the contacts A1 and A2 of the switch A are closed and the contacts B1 and B2 of the switch B are closed, too, when the slider 2 is under the neutral state. Since the contact C1 of the switch C is open, the DC motor 101 is at halt (under the STOP state).

When the slider 2 is moved from this state in the L direction, the push button 4 first moves down and the contacts A1 and A2 of the switch A are opened (while the contacts B1 and B2 of the switch B remain closed), and then the contacts C1 and C2 of the switch C are closed with a predetermined margin time delay (Td1). Consequently, the DC motor 101 rotates in the normal direction (UP).

When the slider 2 is returned to the neutral state, the contacts C1 and C2 of the switch C are first opened and then the push button 4 moves up with a predetermined margin time delay (Td2) with the result that the contacts A1 and A2 of the switch A are closed and the DC motor 101 again comes to halt (STOP).

When the slider 2 is under the neutral state in (II), both contacts A1 and A2 of the switch A are closed, both contacts B1 and B2 of the switch B are closed too, and the contact C1 of the switch C is open. Therefore, the DC motor 101 is at halt (STOP).

When the slider 2 is moved from this state in the R direction, the push button 5 first moves down and the contacts B and B2 of the switch B are opened (while the contacts A1 and A2 of the switch A remain closed), and then the contacts C1 and C3 of the switch C are closed with a predetermined margin time delay (Td3). Consequently, the DC motor 101 rotates in the reverse direction (DOWN).

When the slider 2 is returned to the neutral state, the contacts C1 and C3 of the switch C are first opened and then the push button 5 moves up with a predetermined margin time delay (Td4) with the result that the contacts B1 and B2 of the switch B are closed and the DC motor 101 again comes to halt (STOP).

The margin time Td1 and the margin time Td3 in the drawing correspond to the afore-mentioned close delay time Td_Close, and the margin time Td2 and the margin time Td4 correspond to the afore-mentioned open delay time Td_Open. Each margin time Td1 to Td4 depends on the construction of the switch C, particularly on the sliding length of the flat sheet-like moving plate 9 (contact length of the flat sheet-like moving plate 9 and the metal wiring 7*e*, that is, the length in the transverse direction in FIG. 5). When the sliding length is greater, the timing of "slide and fall" of the flat sheet-like moving plate 9 (close delay time Td Close) is more retarded. Therefore, the margin times Td1 and Td3 can be increased as much. Similarly, the greater the sliding length, the longer becomes the time from the point of departure of the flat sheet-like moving plate 9 from the contact (C2 or C3) to the return point of the slider 2 to the neutral state (open delay time Td_Open). Therefore, the margin times Td2 and Td4 can be increased as much.

As explained already, the objects of the invention are (A) to avoid contact damage without inviting a drastic increase of the scale of the switch unit even when applied to a high power source voltage such as the 42 V electric system and (B) to prevent deterioration of the return feeling to the neutral state.

First, the object (A) will be explained. When the slider 2 is returned from the movement state in the L or R direction (UP or DOWN state) to the neutral state (dead short-circuit often occurs at this time in the prior art) in the embodiment of the invention, the contact C1 of the switch C is first opened and the contacts of the switch A or B are then closed after the passage of the predetermined margin time Td2 or Td4 as can be seen clearly from the state diagrams (I and II) of FIG. 7.

In other words, the dead short-circuit develops as the discharge phenomenon between the contacts connected to the power source when the DC motor 101 is returned from the normal rotation or reverse rotation to the STOP state. In the embodiment, "the contact C1 of the switch C is first opened and the contacts of the switch A or B are then closed after the passage of the predetermined margin time Td2 or Td4" as described above. In other words, prior opening of the contact C1 of the switch C makes it possible to cut off in advance the power source route and to sufficiently secure the arc discharge voltage corresponding to the margin time. For this reason, the voltage (5 to 7 V or more) that can generate dead short-circuit does not remain in the contact C2 or C3 and because the contacts of the switch A or B are closed under this condition, and the occurrence of dead short-circuit can be prevented.

As can be understood from the explanation given above, the margin time necessary for preventing dead short-circuit is "Td2, Td4". Appropriate values of the margin time Td2, Td4 depends on the contact gap and on the magnitude of the power source voltage but may well be from about 1 to about 10 ms, for example.

Next, the object (B) will be explained. The switch C in this embodiment has the slide type construction as can be clearly seen from FIG. 4. In this construction, the sliding resistance of the flat sheet-like moving plate 9 gives the moving resistance of the slider 2 in the L or R direction and its returning resistance to the neutral state. The urging force P of the flexible member 8 determines solely the degree of this sliding resistance. When the urging force P is set to an appropriate value, therefore, the slider 2 can be moved or returned with lighter touch than in the second prior art. Because the push buttons 202*p* and 202*n* do not enter the recesses of the slider 203*a* (lower surface recesses 230*c*) as observed in the prior art, return feeling of the slider 2 can be improved, in particular.

Incidentally, the invention is not limited to the example of the embodiment but naturally includes various modifications within the scope of its concept.

Figure 8A:
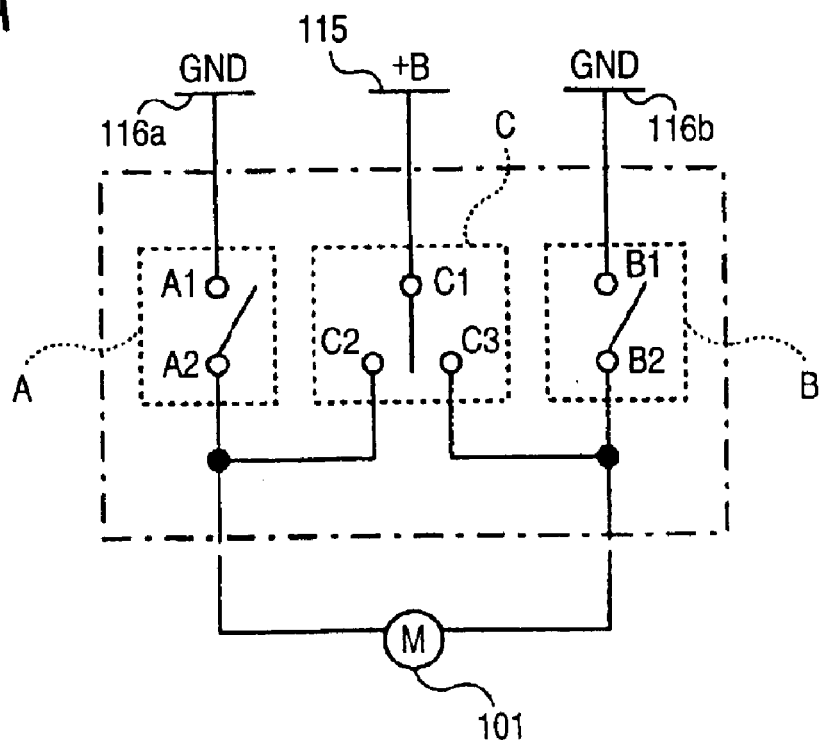
FIG. 8 is circuit diagrams respectively showing first and second modified examples of the switch apparatus 1.

FIG. 8A shows a first modified example. The difference from the construction of the embodiment given above resides in that the switches A and B are of the normally-open type. In this modified example, too, it is possible to cut off in advance the power source route and then to close the contacts of the switch A or B under the cut state to prevent the occurrence of the short-circuit in the same way as in the embodiment by satisfying the condition "the contact C1 of the switch C is first opened and the contacts of the switch A or B are then closed after the passage of the predetermined margin time Td2 or Td4".

Figure 8B:
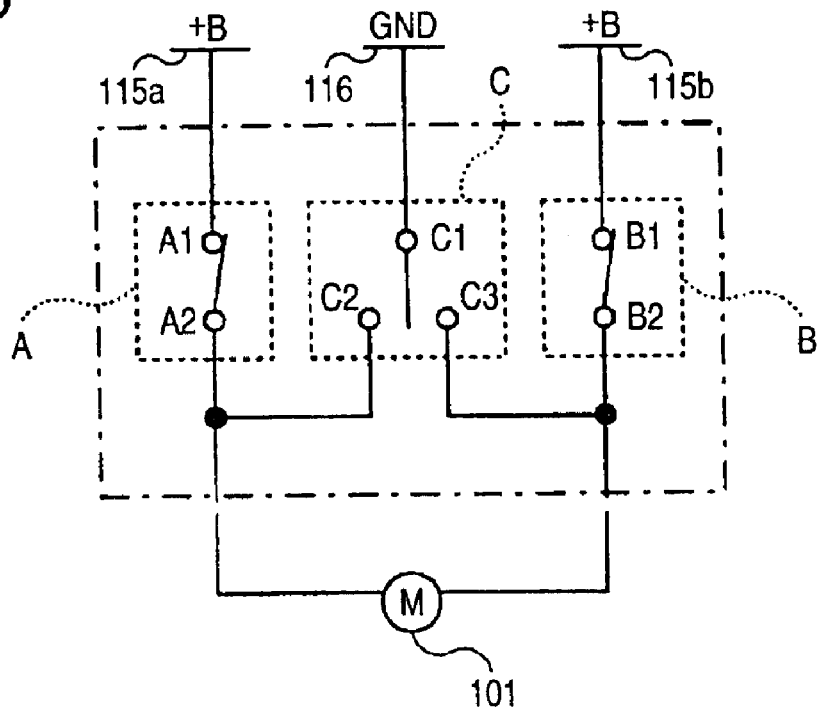

FIG. 8B shows a second modified example. The difference from the construction of the embodiment given above resides in that the switches A and B are connected to the +B lines 115*a* and 115*b* and the switch C is connected to the ground line 116. In this modified example, too, it is possible to cut off in advance the power source route and then to close the contacts of the switch A or B under the cut state to prevent the occurrence of the short-circuit by satisfying the condition "the contact C1 of the switch C is first opened and the contacts of the switch A or B are then closed after the passage of the predetermined margin time Td2 or Td4".

Figure 9A:
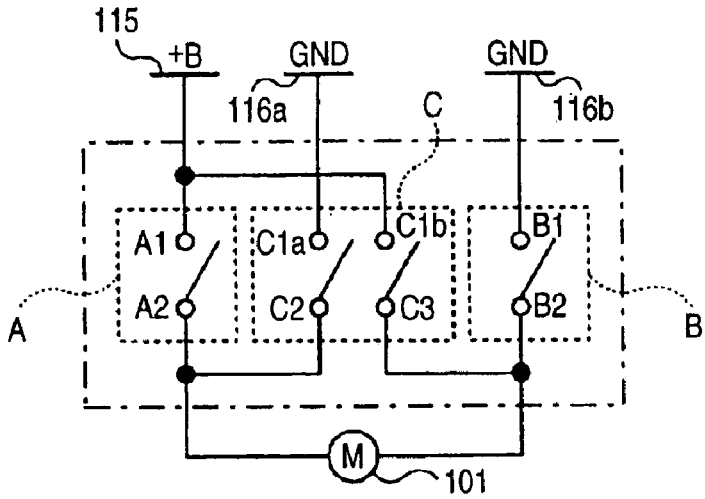
FIG. 9 is circuit diagram showing third to fifth modified examples of the switch apparatus 1.
Figure 9B:
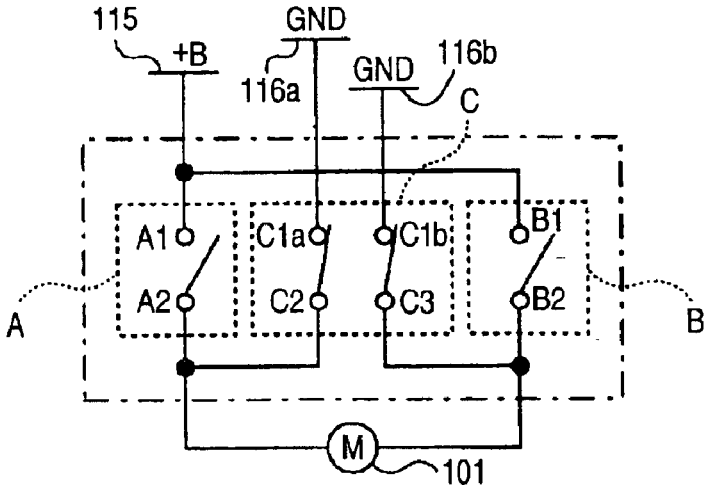
Figure 9C:
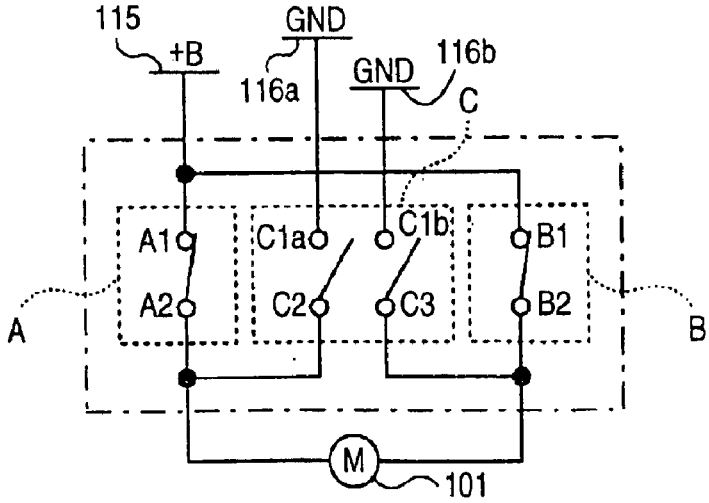

FIGS. 9A to 9C show third to fifth modified examples. In FIGS. 9A and 9B, the differences from the construction of the embodiment given above reside in that the switches A and B are of the normally-open type and that two switches (contacts C1*a* and contact C2, and contact C1*b* and contact C3) constitute the switch C. In FIG. 9C, the difference from the embodiment resides in that two switches (contacts C1*a* and contact C2, and contact C1*b* and contact C3) constitute the switch C. In all of these modified examples, the switch C operates in the same way as the switch C of the embodiment or the switches C of the first ad second modified examples.

According to the invention, the switch C is brought into the open state for a predetermined time before the switch A or B is closed. Therefore, it is possible to cut off in advance the power source route and to eliminate the dead short-circuit problem. When the switch C has the slide type structure, return feeling of the switch C from the closed state to the open state can be improved.

What is claimed is:

1. A switch apparatus for causing a DC motor to stop and rotate normally or reversely by switching a connection state of one side driving input and the other side driving input of said DC motor, a positive plate side power source and a negative plate side power course, comprising:

a switch A for cutting off connection between said one side driving input of said DC motor and said negative plate side power source;

a switch B for cutting off connection between said other side driving input of said DC motor and said negative plate side power source; and a switch C for cutting off connection between said one side driving input of said DC motor and said positive plate side power source and connection between said other side driving input of said DC motor and said positive plate side power source;

wherein said switch A and said switch B are normally-closed type switches, said switch C is a normally-open type switch, and said switch C is opened at a predetermined time before said switch A or said switch B is closed.

2. A switch apparatus according to claim 1, wherein said switch C has a slide type structure.

3. A switch apparatus according to claim 1, wherein said switch A and said switch B are normally-open type switches.

4. A switch apparatus according to claim 1, wherein said switch C comprises two sets of switches.

5. A switch apparatus for causing a DC motor to stop and rotate normally or reversely by switching a connection state of one side driving input and the other side driving input of said DC motor, a positive plate side power source and a negative plate side power source, comprising:

a switch A for cutting off connection between said one side driving input of said DC motor and said positive plate side power source;

a switch B for cutting off connection between said other side driving input of said DC motor and said positive plate side power source; and a switch C for cutting off connection between said one side driving input of said DC motor and said negative plate side power source and connection between said other side driving input of said DC motor and said negative plate side power source;

wherein said switch A and said switch B are normally-closed type switches, said switch C is a normally-open type switch, and said switch C is opened at a predetermined time before said switch A or said switch B is closed.

6. A switch apparatus according to claim 5, wherein said switch C has a slide type structure.

7. A switch apparatus according to claim 5, wherein said switch A and said switch B are normally-open type switches.

8. A switch apparatus according to claim 5, wherein said switch C comprises two sets of switches.

* * * * *